US008698675B2

(12) United States Patent
Shtrom et al.

(10) Patent No.: US 8,698,675 B2
(45) Date of Patent: Apr. 15, 2014

(54) MOUNTABLE ANTENNA ELEMENTS FOR DUAL BAND ANTENNA

(75) Inventors: Victor Shtrom, Los Altos, CA (US); Bernard Baron, Mountain View, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 589 days.

(21) Appl. No.: 12/545,758

(22) Filed: Aug. 21, 2009

(65) Prior Publication Data

US 2010/0289705 A1 Nov. 18, 2010

Related U.S. Application Data

(60) Provisional application No. 61/177,546, filed on May 12, 2009.

(51) Int. Cl.
*H01Q 1/24* (2006.01)

(52) U.S. Cl.
USPC ..... 343/702; 343/700 MS

(58) Field of Classification Search
USPC ..... 343/700, 702
See application file for complete search history.

(56) References Cited

U.S. PATENT DOCUMENTS

| | | | |
|---|---|---|---|
| 723,188 | A | 3/1903 | Tesla |
| 725,605 | A | 4/1903 | Tesla |
| 1,869,659 | A | 8/1932 | Broertjes |
| 2,292,387 | A | 8/1942 | Markey et al. |
| 3,488,445 | A | 1/1970 | Chang |
| 3,568,105 | A | 3/1971 | Felsenheld et al. |
| 3,918,059 | A | 11/1975 | Adrian |
| 3,922,685 | A | 11/1975 | Opas |

(Continued)

FOREIGN PATENT DOCUMENTS

| | | |
|---|---|---|
| EP | 352787 A2 | 1/1990 |
| EP | 0 534 612 | 3/1993 |

(Continued)

OTHER PUBLICATIONS

Tsunekawa, Kouichi, "Diversity Antennas for Portable Telephones," 39th IEEE Vehicular Technology Conference, pp. 50-56, vol. 1, Gateway to New Concepts in Vehicular Technology, May 1-3, 1989, San Francisco, CA.

(Continued)

*Primary Examiner* — Jacob Y Choi
*Assistant Examiner* — Kyana R McCain
(74) *Attorney, Agent, or Firm* — Lewis Roca Rothgerber LLP

(57) ABSTRACT

A mountable antenna element is constructed as an object from a single piece of material and can be configured to transmit and receive RF signals, achieve optimized impedance values, and operate in a concurrent dual-band system. The mountable antenna element may have one or more legs, an RF signal feed, and one or impedance matching elements. The legs and RF signal feed can be coupled to a circuit board. The impedance matching elements can be utilized to create a capacitance with a portion of the circuit board and thereby optimize impedance of the antenna element at a desired operating frequency. The mountable antenna includes features that enable it for use in concurrent dual band operation with the wireless device. Because the mountable antenna element can be installed without needing additional circuitry for matching impedance and can be constructed from a single piece of material, the antenna element provides for more efficient manufacturing.

16 Claims, 14 Drawing Sheets

(56) References Cited

U.S. PATENT DOCUMENTS 3,967,067 A 6/1976 Potter
3,982,214 A 9/1976 Burns
3,991,273 A 11/1976 Mathes
4,001,734 A 1/1977 Burns
4,176,356 A 11/1979 Foster et al.
4,193,077 A 3/1980 Greenberg et al.
4,253,193 A 2/1981 Kennard
4,305,052 A 12/1981 Baril et al.
4,513,412 A 4/1985 Cox
4,554,554 A 11/1985 Olsen et al.
4,733,203 A 3/1988 Ayasli
4,814,777 A 3/1989 Monser
4,845,507 A 7/1989 Archer et al.
5,063,574 A 11/1991 Moose
5,097,484 A 3/1992 Akaiwa
5,173,711 A 12/1992 Takeuchi et al.
5,203,010 A 4/1993 Felix
5,208,564 A 5/1993 Burns et al.
5,220,340 A 6/1993 Shafai
5,282,222 A 1/1994 Fattouche et al.
5,291,289 A 3/1994 Hulyalkar et al.
5,311,550 A 5/1994 Fouche et al.
5,373,548 A 12/1994 McCarthy
5,507,035 A 4/1996 Bantz
5,532,708 A 7/1996 Krenz et al.
5,559,800 A 9/1996 Mousseau et al.
5,610,617 A 3/1997 Gans et al.
5,629,713 A 5/1997 Mailandt et al.
5,754,145 A 5/1998 Evans
5,767,755 A 6/1998 Kim et al.
5,767,809 A 6/1998 Chuang et al.
5,786,793 A 7/1998 Maeda et al.
5,802,312 A 9/1998 Lazaridis et al.
5,964,830 A 10/1999 Durrett
5,990,838 A 11/1999 Burns et al.
6,006,075 A 12/1999 Smith et al.
6,011,450 A 1/2000 Miya
6,018,644 A 1/2000 Minarik
6,031,503 A 2/2000 Preiss, II et al.
6,034,638 A 3/2000 Thiel et al.
6,052,093 A 4/2000 Yao et al.
6,091,364 A 7/2000 Murakami et al.
6,094,177 A 7/2000 Yamamoto
6,097,347 A 8/2000 Duan et al.
6,101,397 A 8/2000 Grob et al.
6,104,356 A 8/2000 Hikuma et al.
6,169,523 B1 1/2001 Ploussios
6,266,528 B1 7/2001 Farzaneh
6,292,153 B1 9/2001 Aiello et al.
6,307,524 B1 10/2001 Britain
6,317,599 B1 11/2001 Rappaport et al.
6,323,810 B1 11/2001 Poilasne et al.
6,326,922 B1 12/2001 Hegendoerfer
6,337,628 B2 1/2002 Campana et al.
6,337,668 B1 1/2002 Ito et al.
6,339,404 B1 1/2002 Johnson et al.
6,345,043 B1 2/2002 Hsu
6,356,242 B1 3/2002 Ploussios
6,356,243 B1 3/2002 Schneider et al.
6,356,905 B1 3/2002 Gershman et al.
6,377,227 B1 4/2002 Zhu et al.
6,392,610 B1 5/2002 Braun et al.
6,404,386 B1 6/2002 Proctor, Jr. et al.
6,407,719 B1 6/2002 Ohira et al.
RE37,802 E 7/2002 Fattouche et al.
6,414,647 B1 7/2002 Lee
6,424,311 B1 7/2002 Tsai et al.
6,442,507 B1 8/2002 Skidmore et al.
6,445,688 B1 9/2002 Garces et al.
6,452,981 B1 9/2002 Raleigh
6,456,242 B1 9/2002 Crawford
6,493,679 B1 12/2002 Rappaport et al.
6,496,083 B1 12/2002 Kushitani et al.
6,498,589 B1 12/2002 Horii
6,499,006 B1 12/2002 Rappaport et al.
6,507,321 B2 1/2003 Oberschmidt et al.
6,531,985 B1 3/2003 Jones et al.
6,583,765 B1 6/2003 Schamberger et al.
6,586,786 B2 7/2003 Kitazawa et al.
6,611,230 B2 8/2003 Phelan
6,621,464 B1 9/2003 Fang
6,625,454 B1 9/2003 Rappaport et al.
6,633,206 B1 10/2003 Kato
6,642,889 B1 11/2003 McGrath
6,674,459 B2 1/2004 Ben-Shachar et al.
6,701,522 B1 3/2004 Rubin et al.
6,720,925 B2 4/2004 Wong et al.
6,724,346 B2 4/2004 Le Bolzer
6,725,281 B1 4/2004 Zintel et al.
6,741,219 B2 5/2004 Shor
6,747,605 B2 6/2004 Lebaric
6,753,814 B2 6/2004 Killen et al.
6,762,723 B2 7/2004 Nallo et al.
6,774,846 B2 8/2004 Fullerton et al.
6,779,004 B1 8/2004 Zintel
6,801,790 B2 10/2004 Rudrapatna
6,819,287 B2 11/2004 Sullivan et al.
6,839,038 B2 1/2005 Weinstein
6,859,176 B2 2/2005 Choi
6,859,182 B2 2/2005 Horii
6,876,280 B2 4/2005 Nakano
6,876,836 B2 4/2005 Lin et al.
6,888,504 B2 5/2005 Chiang et al.
6,888,893 B2 5/2005 Li et al.
6,892,230 B1 5/2005 Gu et al.
6,903,686 B2 6/2005 Vance et al.
6,906,678 B2 6/2005 Chen
6,910,068 B2 6/2005 Zintel et al.
6,914,581 B1 7/2005 Popek
6,924,768 B2 8/2005 Wu et al.
6,931,429 B2 8/2005 Gouge et al.
6,941,143 B2 9/2005 Mathur
6,943,749 B2 9/2005 Paun
6,950,019 B2 9/2005 Bellone et al.
6,950,069 B2 9/2005 Gaucher et al.
6,961,026 B2 11/2005 Toda
6,961,028 B2 11/2005 Joy et al.
6,965,353 B2 11/2005 Shirosaka et al.
6,973,622 B1 12/2005 Rappaport et al.
6,975,834 B1 12/2005 Forster
6,980,782 B1 12/2005 Braun et al.
7,023,909 B1 4/2006 Adams et al.
7,034,769 B2 4/2006 Surducan et al.
7,034,770 B2 4/2006 Yang et al.
7,039,363 B1 5/2006 Kasapi et al.
7,043,277 B1 5/2006 Pfister
7,050,809 B2 5/2006 Lim
7,053,844 B2 5/2006 Gaucher et al.
7,053,845 B1 5/2006 Holloway et al.
7,064,717 B2 6/2006 Kaluzni et al.
7,075,485 B2 7/2006 Song et al.
7,084,823 B2 8/2006 Caimi et al.
7,085,814 B1 8/2006 Ghandi et al.
7,088,299 B2 8/2006 Siegler et al.
7,089,307 B2 8/2006 Zintel et al.
7,130,895 B2 10/2006 Zintel et al.
7,171,475 B2 1/2007 Weisman et al.
7,193,562 B2 3/2007 Shtrom et al.
7,277,063 B2 10/2007 Shirosaka et al.
7,308,047 B2 12/2007 Sadowsky
7,312,762 B2 12/2007 Puente Ballards et al.
7,319,432 B2 1/2008 Andersson
7,362,280 B2 4/2008 Shtrom et al.
7,414,583 B2 * 8/2008 Choi et al. ..... 343/700 MS
7,424,298 B2 9/2008 Lastinger et al.
7,493,143 B2 2/2009 Jalali
7,498,996 B2 3/2009 Shtrom et al.
7,525,486 B2 4/2009 Shtrom et al.
7,603,141 B2 10/2009 Dravida
7,646,343 B2 1/2010 Shtrom et al.
7,652,632 B2 1/2010 Shtrom et al.
7,675,474 B2 3/2010 Shtrom et al.
7,696,940 B1 4/2010 Macdonald
7,696,943 B2 4/2010 Chiang et al.

(56) References Cited

U.S. PATENT DOCUMENTS

| | | | | |
|---|---|---|---|---|
| 7,696,948 | B2 | 4/2010 | Abramov et al. | |
| 7,880,683 | B2 | 2/2011 | Shtrom et al. | |
| 7,899,497 | B2 | 3/2011 | Kish et al. | |
| 7,965,252 | B2 | 6/2011 | Shtrom et al. | |
| 8,031,129 | B2 | 10/2011 | Shtrom et al. | |
| 8,314,749 | B2 | 11/2012 | Shtrom et al. | |
| 2001/0046848 | A1 | 11/2001 | Kenkel | |
| 2002/0031130 | A1 | 3/2002 | Tsuchiya et al. | |
| 2002/0047800 | A1 | 4/2002 | Proctor, Jr. et al. | |
| 2002/0054580 | A1 | 5/2002 | Strich et al. | |
| 2002/0080767 | A1 | 6/2002 | Lee | |
| 2002/0084942 | A1 | 7/2002 | Tsai et al. | |
| 2002/0101377 | A1 | 8/2002 | Crawford | |
| 2002/0105471 | A1 | 8/2002 | Kojima et al. | |
| 2002/0112058 | A1 | 8/2002 | Weisman et al. | |
| 2002/0140607 | A1* | 10/2002 | Zhou | 343/700 MS |
| 2002/0158798 | A1 | 10/2002 | Chiang et al. | |
| 2002/0170064 | A1 | 11/2002 | Monroe et al. | |
| 2003/0026240 | A1 | 2/2003 | Eyuboglu et al. | |
| 2003/0030588 | A1 | 2/2003 | Kalis et al. | |
| 2003/0063591 | A1 | 4/2003 | Leung et al. | |
| 2003/0122714 | A1 | 7/2003 | Wannagot et al. | |
| 2003/0169330 | A1 | 9/2003 | Ben-Shachar et al. | |
| 2003/0184490 | A1 | 10/2003 | Raiman et al. | |
| 2003/0189514 | A1 | 10/2003 | Miyano et al. | |
| 2003/0189521 | A1 | 10/2003 | Yamamoto et al. | |
| 2003/0189523 | A1 | 10/2003 | Ojantakanen et al. | |
| 2003/0210207 | A1 | 11/2003 | Suh et al. | |
| 2003/0227414 | A1 | 12/2003 | Saliga et al. | |
| 2004/0014432 | A1 | 1/2004 | Boyle | |
| 2004/0017310 | A1 | 1/2004 | Runkle et al. | |
| 2004/0017860 | A1 | 1/2004 | Liu | |
| 2004/0027291 | A1 | 2/2004 | Zhang et al. | |
| 2004/0027304 | A1 | 2/2004 | Chiang et al. | |
| 2004/0032378 | A1 | 2/2004 | Volman et al. | |
| 2004/0036651 | A1 | 2/2004 | Toda | |
| 2004/0036654 | A1 | 2/2004 | Hsieh | |
| 2004/0041732 | A1 | 3/2004 | Aikawa et al. | |
| 2004/0048593 | A1 | 3/2004 | Sano | |
| 2004/0058690 | A1 | 3/2004 | Ratzel et al. | |
| 2004/0061653 | A1 | 4/2004 | Webb et al. | |
| 2004/0070543 | A1 | 4/2004 | Masaki | |
| 2004/0080455 | A1 | 4/2004 | Lee | |
| 2004/0095278 | A1 | 5/2004 | Kanemoto et al. | |
| 2004/0114535 | A1 | 6/2004 | Hoffmann et al. | |
| 2004/0125777 | A1 | 7/2004 | Doyle et al. | |
| 2004/0145528 | A1 | 7/2004 | Mukai et al. | |
| 2004/0160376 | A1 | 8/2004 | Hornsby et al. | |
| 2004/0190477 | A1 | 9/2004 | Olson et al. | |
| 2004/0203347 | A1 | 10/2004 | Nguyen | |
| 2004/0260800 | A1 | 12/2004 | Gu et al. | |
| 2005/0022210 | A1 | 1/2005 | Zintel et al. | |
| 2005/0041739 | A1 | 2/2005 | Li et al. | |
| 2005/0042988 | A1 | 2/2005 | Hoek et al. | |
| 2005/0048934 | A1 | 3/2005 | Rawnick et al. | |
| 2005/0074018 | A1 | 4/2005 | Zintel et al. | |
| 2005/0097503 | A1 | 5/2005 | Zintel et al. | |
| 2005/0105632 | A1 | 5/2005 | Catreux-Erces et al. | |
| 2005/0128983 | A1 | 6/2005 | Kim et al. | |
| 2005/0135480 | A1 | 6/2005 | Li et al. | |
| 2005/0138137 | A1 | 6/2005 | Encarnacion et al. | |
| 2005/0138193 | A1 | 6/2005 | Encarnacion et al. | |
| 2005/0146475 | A1 | 7/2005 | Bettner et al. | |
| 2005/0180381 | A1 | 8/2005 | Retzer et al. | |
| 2005/0188193 | A1 | 8/2005 | Kuehnel et al. | |
| 2005/0219128 | A1* | 10/2005 | Tan et al. | 343/702 |
| 2005/0240665 | A1 | 10/2005 | Gu et al. | |
| 2005/0266902 | A1 | 12/2005 | Khatri | |
| 2005/0267935 | A1 | 12/2005 | Ghandi et al. | |
| 2006/0007891 | A1 | 1/2006 | Aoki et al. | |
| 2006/0038734 | A1 | 2/2006 | Shtrom et al. | |
| 2006/0050005 | A1 | 3/2006 | Shirosaka et al. | |
| 2006/0078066 | A1 | 4/2006 | Yun | |
| 2006/0094371 | A1 | 5/2006 | Nguyen | |
| 2006/0098607 | A1 | 5/2006 | Zeng et al. | |
| 2006/0123124 | A1 | 6/2006 | Weisman et al. | |
| 2006/0123125 | A1 | 6/2006 | Weisman et al. | |
| 2006/0123455 | A1 | 6/2006 | Pai et al. | |
| 2006/0160495 | A1 | 7/2006 | Strong | |
| 2006/0168159 | A1 | 7/2006 | Weisman et al. | |
| 2006/0184660 | A1 | 8/2006 | Rao et al. | |
| 2006/0184661 | A1 | 8/2006 | Weisman et al. | |
| 2006/0184693 | A1 | 8/2006 | Rao et al. | |
| 2006/0224690 | A1 | 10/2006 | Falkenburg et al. | |
| 2006/0225107 | A1 | 10/2006 | Seetharaman et al. | |
| 2006/0227761 | A1 | 10/2006 | Scott, III et al. | |
| 2006/0239369 | A1 | 10/2006 | Lee | |
| 2006/0262015 | A1 | 11/2006 | Thornell-Pers et al. | |
| 2006/0291434 | A1 | 12/2006 | Gu et al. | |
| 2007/0027622 | A1 | 2/2007 | Cleron et al. | |
| 2007/0135167 | A1 | 6/2007 | Liu | |
| 2007/0162819 | A1 | 7/2007 | Kawamoto | |
| 2008/0266189 | A1* | 10/2008 | Wu | 343/702 |
| 2009/0075606 | A1 | 3/2009 | Shtrom et al. | |
| 2011/0205137 | A1 | 8/2011 | Shtrom et al. | |
| 2012/0007790 | A1 | 1/2012 | Shtrom et al. | |
| 2012/0068892 | A1 | 3/2012 | Shtrom et al. | |

FOREIGN PATENT DOCUMENTS

| | | | |
|---|---|---|---|
| EP | 0756381 | A2 | 1/1997 |
| EP | 1 152 452 | | 11/2001 |
| EP | 1152543 | A1 | 11/2001 |
| EP | 1 376 920 | | 6/2002 |
| EP | 1220461 | A2 | 7/2002 |
| EP | 1 315 311 | | 5/2003 |
| EP | 1 450 521 | | 8/2004 |
| EP | 1 608 108 | | 12/2005 |
| EP | 1 152 453 | | 11/2011 |
| JP | 03038933 | | 2/1991 |
| JP | 2008/088633 | | 2/1996 |
| JP | 2011-215040 | | 8/1999 |
| JP | 2001/057560 | | 2/2002 |
| JP | 2005/354249 | | 12/2005 |
| JP | 2006/060408 | | 3/2006 |
| WO | WO 90/04893 | | 5/1990 |
| WO | WO 02/25967 | | 3/2002 |
| WO | WO 03/079484 | | 9/2003 |
| WO | WO2006023247 | A1 | 3/2006 |

OTHER PUBLICATIONS

Supplementary European Search Report for foreign application No. EP07755519 dated Mar. 11, 2009.

Ando et al., "Study of Dual-Polarized Omni-Directional Antennas for 5.2 GHz-Band 2×2 MIMO-OFDM Systems," Antennas and Propagation Society International Symposium, 2004, IEEE, pp. 1740-1743, vol. 2.

Bedell, Paul, "Wireless Crash Course," 2005, p. 84, The McGraw-Hill Companies, Inc., USA.

Petition Decision Denying Request to Order Additional Claims for U.S. Patent No. 7,193,562 (Control No. 95/001078) mailed on Jul. 10, 2009.

Right of Appeal Notice for U.S. Patent No. 7,193,562 (Control No. 95/001078) mailed on Jul. 10, 2009.

Chuang et al., "A 2.4 GHz Polarization-diversity Planar Printed Diopoe Antenna for WLAN and Wireless Communication Applications," Microwave Journal, vol. 45, No. 6, pp. 50-62, Jun. 2002.

Frederick et al., Smart Antennas Based on Spatial Multiplexing of Local Elements (SMILE) for Mutual Coupling Reduction, IEEE Transactions of Antennas and Propagation, vol. 52, No. 1, pp. 106-114, Jan. 2004.

W. E. Doherty, Jr. et al., "The Pin Diode Circuit Designer's Handbook," 1998.

Varnes et al., "A Switched Radial Divider for an L-Band Mobile Satellite Antenna," European Microwave Conference, Oct. 1995, pp. 1037-1041.

English Translation of PCT Pub. No. WO2004/051798 (as filed U.S. Appl. No. 10/536,547).

Behdad et al., "Slot Antenna Miniaturization Using Distributed Inductive Loading," Antenna and Propagation Society International Symposium, 2003 IEEE, vol. 1, pp. 308-311, Jun. 2003.

(56) References Cited

OTHER PUBLICATIONS

Press Release, "Netgear RangeMax(TM) Wireless Solutions Incorporate Smart MIMO Technology to Eliminate Wireless Dead Spots and Take Consumers Farther," Ruckus Wireless, Inc., Mar. 7, 2005. Available at: http://ruckuswireless.com/press/releases/20050307.php.
"Authorization of Spread Spectrum Systems Under Parts 15 and 90 of the FCC Rules and Regulations," Rules and Regulations Federal Communications Commission, 47 CFR Part 2, 15, and 90, Jun. 18, 1985.
"Authorization of spread spectrum and other wideband emissions not presently provided for in the FCC Rules and Regulations," Before the Federal Communications Commission, FCC 81-289, 87 F.C.C.2d 876, Gen Docket No.81-413, Jun. 30, 1981.
RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.
Chang, Robert W., "Synthesis of Band-Limited Orthogonal Signals for Multichannel Data Transmission," The Bell System Technical Journal, Dec. 1966, pp. 1775-1796.
Cimini, Jr., Leonard J., "Analysis and Simulation of a Digital Mobile Channel Using Orthogonal Frequency Division Multiplexing," IEEE Transactions on Communications, vol. Com-33, No. 7, Jul. 1985, pp. 665-675.
Saltzberg, Burton R., "Performance of an Efficient Parallel Data Transmission System," IEEE Transactions on Communication Technology, vol. Com-15, No. 6., Dec. 1967, pp. 805-811.
Weinstein, S.B., et al., "Data Transmission by Frequency-Division Multiplexing Using Discrete Fourier Transform," IEEE Transactions on Communication Technology, vol. Com-19, No. 5, Oct. 1971, pp. 628-634.
Moose, Paul H., "Differential Modulation and Demodulation of Multi-Frequency Digital Communications Signals," 1990 IEEE, CH2831-6/90/0000-0273.
Casas, Eduardo F., et al., "OFDM for Data Communication Over Mobile Radio FM Channels—Part I: Analysis and Experimental Results," IEEE Transactions on Communications, vol. 39, No. 5., May 1991, pp. 783-793.
Casas, Eduardo F., et al., "OFDM for Data Communication Over Mobile Radio FM Channels—Part II: Performance Improvement," Department of Electrical Engineering, University of British Columbia.
Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.
Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.
Alard, M., et al., "Principles of Modulation and Channel Coding for Digital Broadcasting for Mobile Receivers," 8301 EBU Review Technical, Aug. 1987, No. 224, Brussels, Belgium.
Berenguer, Inaki, et al., "Adaptive MIMO Antenna Selection," Nov. 2003.
Gaur, Sudhanshu, et al., "Transmit/Receive Antenna Selection for MIMO Systems to Improve Error Performance of Linear Receivers," School of ECE, Georgia Institute of Technology, Apr. 4, 2005.
Sadek, Mirette, et al., "Active Antenna Selection in Multiuser MIMO Communications," IEEE Transactions on Signal Processing, vol. 55, No. 4, Apr. 2007, pp. 1498-1510.
Molisch, Andreas F., et al., "MIMO Systems with Antenna Selection—an Overview," Draft, Dec. 31, 2003.
Tang, Ken, et al., "MAC Layer Broadcast Support in 802.11 Wireless Networks," Computer Science Department, University of California, Los Angeles, 2000 IEEE, pp. 544-548.
Tang, Ken, et al., "MAC Reliable Broadcast in Ad Hoc Networks," Computer Science Department, University of California, Los Angeles, 2001 IEEE, pp. 1008-1013.
Park, Vincent D., et al., "A Performance Comparison of the Temporally-Ordered Routing Algorithm and Ideal Link-State Routing," IEEE, Jul. 1998, pp. 592-598.
Akyildiz, Ian F., et al., "A Virtual Topology Based Routing Protocol for Multihop Dynamic Wireless Networks," Broadband and Wireless Networking Lab, School of Electrical and Computer Engineering, Georgia Institute of Technology.
Dell Inc., "How Much Broadcast and Multicast Traffic Should I Allow in my Network," PowerConnect Application Note #5, Nov. 2003.
Toskala, Antti, "Enhancement of Broadcast and Introduction of Multicast Capabilities in RAN," Nokia Networks, Palm Springs, California, Mar. 13-16, 2001.
Microsoft Corporation, "IEEE 802.11 Networks and Windows XP," Windows Hardware Developer Central, Dec. 4, 2001.
Festag, Andreas, "What is MOMBASA?" Telecommunication Networks Group (TKN), Technical University of Berlin, Mar. 7, 2002.
Hewlett Packard, "HP ProCurve Networking: Enterprise Wireless LAN Networking and Mobility Solutions," 2003.
Dutta, Ashutosh, et al., "MarconiNet Supporting Streaming Media Over Localized Wireless Multicast," Proc. of the 2d Int'l Workshop on Mobile Commerce, 2002.
Dunkels, Adam, et al., "Making TCP/IP Viable for Wireless Sensor Networks," Proc. Of the 1st Euro. Workshop on Wireless Sensor Networks, Berlin, Jan. 2004.
Dunkels, Adam, et al., "Connecting Wireless Sensornets with TCP/IP Networks," Proc. Of the 2nd Int'l Conf. on Wired Networks, Frankfurt, Feb. 2004.
Cisco Systems, "Cisco Aironet Access Point Software Configuration Guide: Configuring Filters and Quality of Service," Aug. 2003.
Hirayama, Koji, et al., "Next Generation Mobile-Access IP Network" Hitachi Review, vol. 49, No. 4, 2000.
Calhoun, Pat, et al., "802.11r strengthens wireless voice," Technology Update, Network World, Aug. 22, 2005. http://www.networkworld.com/news/tech/2005/082208techupdate.html.
Alimian, Areg, et al., "Analysis of Roaming Techniques," doc.:IEEE 802.11-04/0377r1, Submission, Mar. 2004.
Information Society Technologies Ultrawaves, "System Concept / Architecture Design and Communcation Stack Requirement Document," Feb. 23, 2004.
Golmie, Nada, "Coexistence in Wireless Networks: Challenges and System-Level Solutions in the Unlicensed Bands," Cambridge University Press, 2006.
Mawa, Rakesh, "Power Control in 3G Systems," Hughes Systique Corporation, Jun. 28, 2006.
Wennstrom, Mattias, et al., "Transmit Antenna Diversity in Ricean Fading MIMO Channels with Co-Channel Interference," 2001.
Steger, Christopher, et al., "Performance of IEEE 802.11b Wireless LAN in an Emulated Mobile Channel, " 2003.
Chang, Nicholas B., et al., "Optimal Channel Probing and Transmission Scheduling for Opportunistics Spectrum Access" Sep. 2007.
PCT/US07/09278, PCT Search Report and Written Opinion mailed Aug. 18, 2008.
PCT/US11/052661, PCT Search Report and Written Opinion mailed Jan. 17, 2012.
Chinese patent application No. 200780023325.X, First Office Action mailed Feb. 13, 2012.
U.S. Appl. No. 11/413,670, Final Office Action mailed Jul. 13, 2009.
U.S. Appl. No. 11/413,670, Office Action mailed Jan. 6, 2009.
U.S. Appl. No. 11/413,670, Final Office Action mailed Aug. 11, 2008.
U.S. Appl. No. 11/413,670, Office Action mailed Feb. 4, 2008.
U.S. Appl. No. 11/414,117, Final Office Action mailed Jul. 6, 2009.
U.S. Appl. No. 11/414,117, Office Action mailed Sep. 25, 2008.
U.S. Appl. No. 11/414,117, Office Action mailed Mar. 21, 2008.
U.S. Appl. No. 12/605,256, Office Action mailed Dec. 28, 2010.
U.S. Appl. No. 13/240,687, Office Action mailed Feb. 22, 2012.
U.S. Appl. No. 12/887,448, Office Action mailed Jan. 7, 2013.

* cited by examiner

Replacement Sheet

MOUNTABLE ANTENNA ELEMENTS FOR DUAL BAND ANTENNA

CROSS-REFERENCE TO RELATED APPLICATION

The present application claims the priority benefit of U.S. provisional patent application No. 61/177,546 filed May 12, 2009 and entitled "Mountable Antenna Elements for Dual Band Antenna," the disclosure of which is incorporated herein by reference.

BACKGROUND OF THE INVENTION

1. Field of the Invention

The present invention generally relates to wireless communications. More specifically, the present invention relates to mountable antenna elements for dual band antenna arrays.

2. Description of the Related Art

In wireless communications systems, there is an ever-increasing demand for higher data throughput and reduced interference that can disrupt data communications. A wireless link in an Institute of Electrical and Electronic Engineers (IEEE) 802.11 network may be susceptible to interference from other access points and stations, other radio transmitting devices, and changes or disturbances in the wireless link environment between an access point and remote receiving node. The interference may degrade the wireless link thereby forcing communication at a lower data rate. The interference may, in some instances, be sufficiently strong as to disrupt the wireless link altogether.

FIG. 1 is a block diagram of a wireless device 100 in communication with one or more remote devices and as is generally known in the art. While not shown, the wireless device 100 of FIG. 1 includes antenna elements and a radio frequency (RF) transmitter and/or a receiver, which may operate using the 802.11 protocol. The wireless device 100 of FIG. 1 may be encompassed in a set-top box, a laptop computer, a television, a Personal Computer Memory Card International Association (PCMCIA) card, a remote control, a mobile telephone or smart phone, a handheld gaming device, a remote terminal, or other mobile device.

In one particular example, the wireless device 100 may be a handheld device that receives input through an input mechanism configured to be used by a user. The wireless device 100 may process the input and generate a corresponding RF signal, as may be appropriate. The generated RF signal may then be transmitted to one or more receiving nodes 110-140 via wireless links. Nodes 120-140 may receive data, transmit data, or transmit and receive data (i.e., a transceiver).

Wireless device 100 may also be an access point for communicating with one or more remote receiving nodes over a wireless link as might occur in an 802.11 wireless network. The wireless device 100 may receive data as a part of a data signal from a router connected to the Internet (not shown) or a wired network. The wireless device 100 may then convert and wirelessly transmit the data to one or more remote receiving nodes (e.g., receiving nodes 110-140). The wireless device 100 may also receive a wireless transmission of data from one or more of nodes 110-140, convert the received data, and allow for transmission of that converted data over the Internet via the aforementioned router or some other wired device. The wireless device 100 may also form a part of a wireless local area network (LAN) that allows for communications among two or more of nodes 110-140.

For example, node 110 may be a mobile device with WiFi capability. Node 110 (mobile device) may communicate with node 120, which may be a laptop computer including a WiFi card or wireless chipset. Communications by and between node 110 and node 120 may be routed through the wireless device 100, which creates the wireless LAN environment through the emission of RF and 802.11 compliant signals.

Efficient manufacturing of wireless device 100 is important to provide a competitive product in the market place. Manufacture of a wireless device 100 typically includes construction of one or more circuit boards and one or more antenna elements. The antenna elements can be built into the circuit board or manually mounted to the wireless device. When mounted manually, the antenna elements are attached to the surface of the circuit board and typically soldered although those elements may be attached by other means.

When surface-mounted antenna elements are used in a wireless device, the impedance of the antenna elements should be matched to achieve optimal efficiency of the wireless device. Previous surface-mount antenna elements require circuitry components for matching the antenna element impedance. For example, wireless device circuit boards are designed to have circuitry components such as capacitors and inductors which match impedance of the surface-mounted antenna elements. Additionally, some surface mounted antenna elements require additional elements to create a capacitance that matches the impedance of the antenna element. Manufacture of wireless devices with surface-mount antenna elements and separate impendence matching components is inefficient and increases manufacturing costs for the device.

SUMMARY OF THE PRESENTLY CLAIMED INVENTION

A first embodiment of a mountable antenna element for transmitting a radio frequency signal includes a top surface, a radio frequency feed, a plurality of legs, and an impedance matching element. The top surface is in a first plane. The radio frequency (RF) feed extends from the top surface and is coupled to an RF source. The impedance matching element extends from the top surface. The impedance matching element can achieve an impedance for the antenna element when the antenna element radiates the RF signal. The top surface, RF feed element, plurality of legs, and impedance matching element are constructed as a single object.

In a second claimed embodiment, a printed circuit board mountable reflector configured to reflect an RFID signal includes a stem, an element connected to the stem and a least one coupling plate coupled to a base of the stem. The stem is configured to extend away from the PCB and the element extends perpendicular to the stem. The at least one coupling plate is configured to be coupled to the PCB. A coupling plate is coupled to a base of the second end and configured to be coupled to the mounting surface.

In a second claimed embodiment, a wireless device for transmitting a radiation signal can include a circuit board, a mountable antenna element and a radio modulator/demodulator. The circuit board is configured to receive a first mountable antenna element for radiating at a first frequency.

The mountable antenna is coupled to the circuit board and includes an RF feed, a top surface, a plurality of legs, and an impedance matching element. The plurality of legs may couple the first mountable antenna element to the PCB. The impedance matching element configured to form a capacitance with respect to a ground layer in the PCB. The radio modulator/demodulator is configured to provide an RF signal to the mountable antenna element at the first frequency.

DETAILED DESCRIPTION

Figure 1:
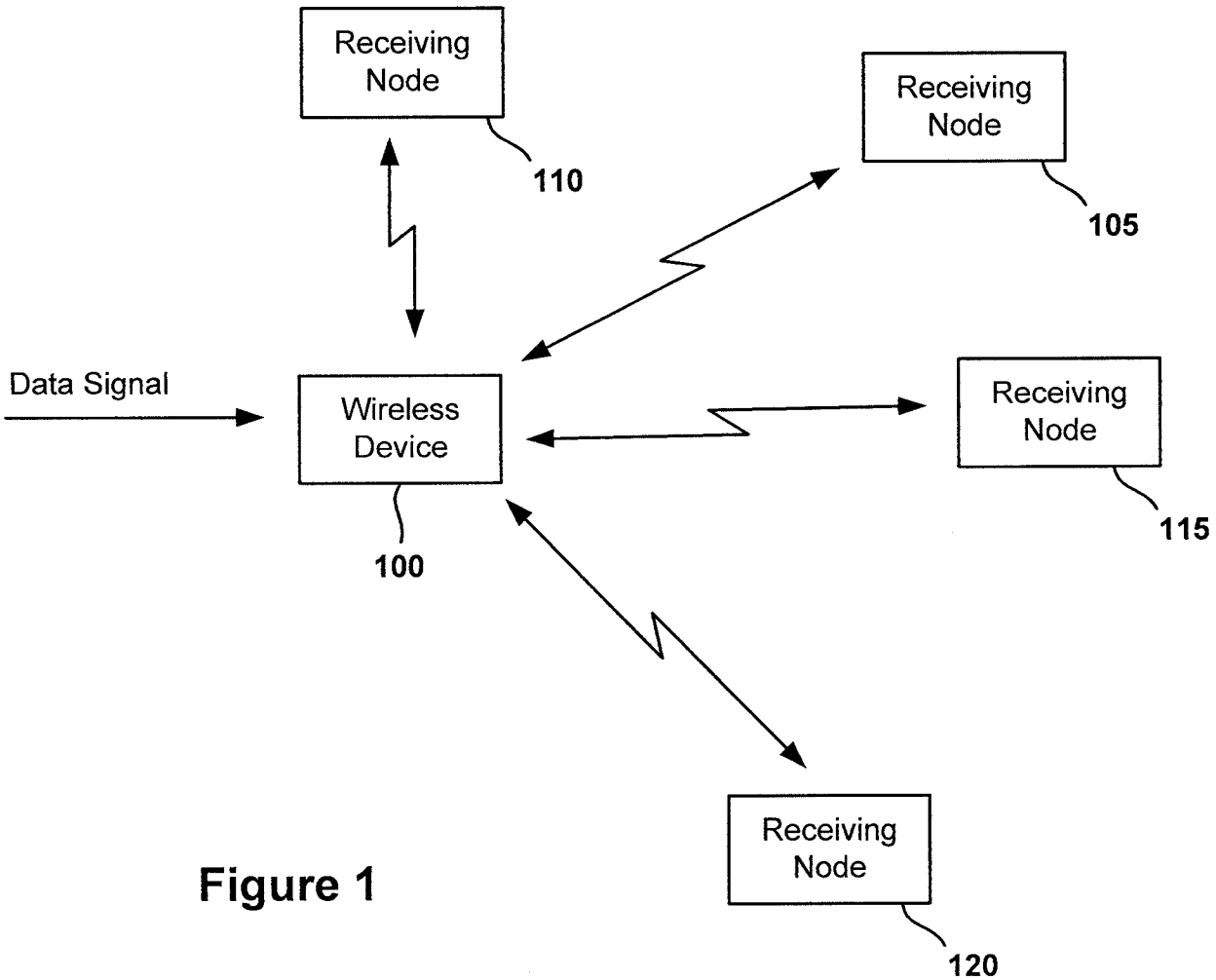
FIG. 1 is a block diagram of a wireless device in communication with one or more remote devices.

A mountable antenna element constructed as a single element or object from a single piece of material can be configured to transmit and receive RF signals, achieve optimized impedance values, and operate in a concurrent dual-band system. The mountable antenna element may have one or more legs, an RF signal feed, and one or more impedance matching elements. The legs and RF signal feed can be coupled to a circuit board. The impedance matching elements can be utilized to create a capacitance with a portion of the circuit board thereby optimizing impedance of the antenna element at a desired operating frequency. The mountable antenna can also include one or more stubs that enable it for use in concurrent dual band operation with the wireless device. Because the mountable antenna element can be installed without the need for additional circuitry to match impedance and can be constructed as a single object or as a single piece of material, the mountable antenna element allows for more efficient manufacturing.

The one or more impedance matching elements of the mountable antenna element are configured to achieve optimized impedance for the mountable antenna element. The impedance matching elements are part of the single object comprising the antenna element, and positioned downward away from a top surface of the mountable antenna and towards a circuit board ground plane. The one or more impedance matching elements may each achieve a capacitance with respect to the ground plane, wherein the capacitance achieves the impedance matching for the antenna element. The impedance matching for the mountable antenna allows for a cleaner and more efficient signal to be broadcast (and received) at a desired frequency for the antenna element.

The legs of the antenna element may each contain one or more stubs in a close proximity of the leg. The stubs are configured to create an open circuit in the leg for a particular frequency. The open circuit prevents current from being induced up the leg and into the mountable antenna element thereby affecting radiation of a smaller sized antenna due to a larger antenna element associated with the leg. The larger mountable antenna element is "transparent," or does not interfere with a smaller mountable antenna element, as a result of preventing an induced current in the larger antenna element due to radiation from the smaller antenna element.

A reflector may also be mounted to a circuit board having a mountable antenna element. The reflector can reflect radiation emitted by the antenna element. The reflector can be constructed as an element or object from a single piece of material and mounted to the circuit board in a position appropriate for reflecting radiation emitted from the antenna element. The reflector can include one or more pins and a plate for installing the reflector to the circuit board. When reflector pins are inserted into designated holes in the circuit board and the reflector plate is in contact with a circuit board pad, the reflector may stand on its own. As a result, the process of securing the reflector to the circuit board is made easier.

Figure 2:
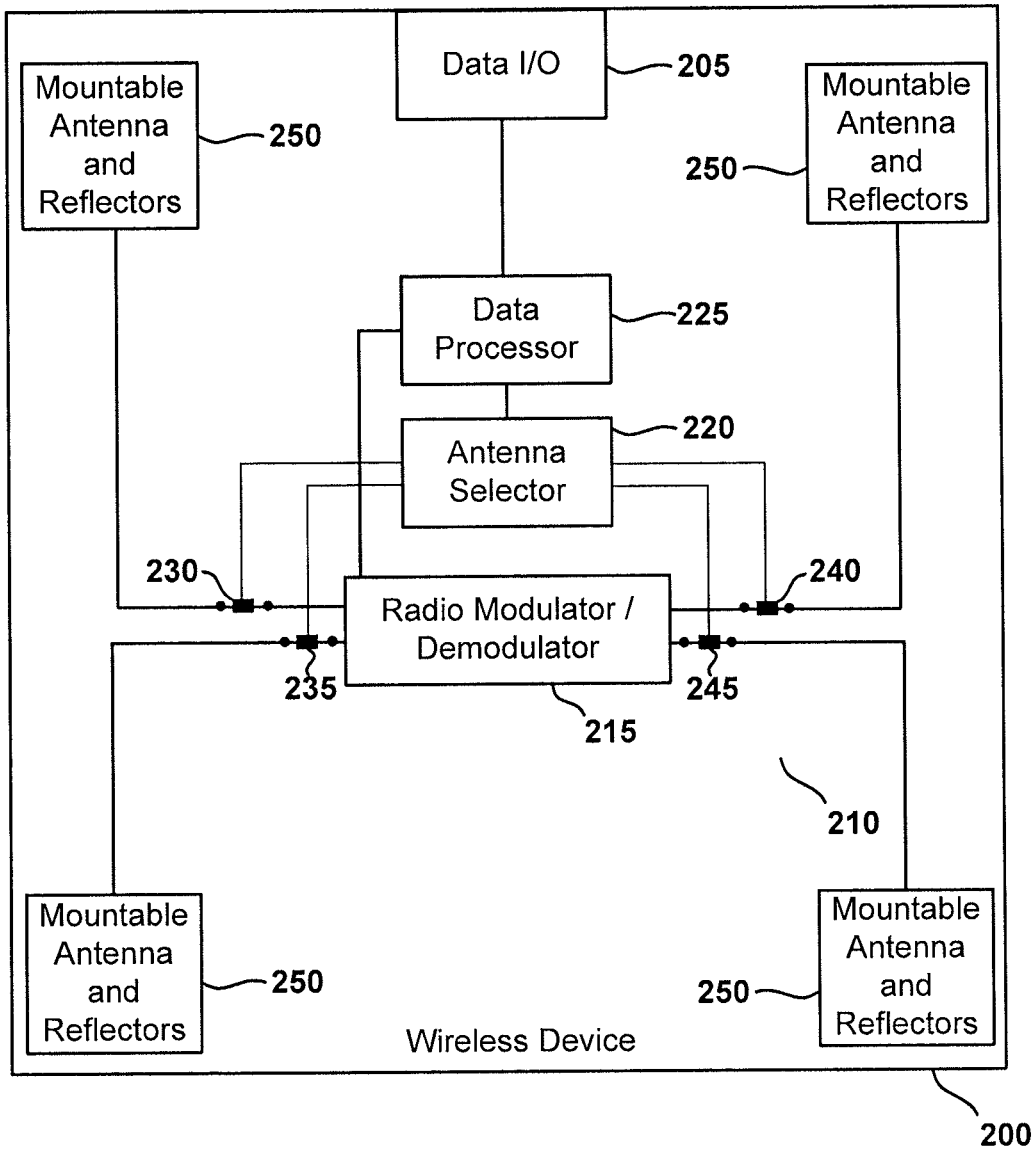
FIG. 2 a block diagram of a wireless device.

FIG. 2 is a block diagram of a wireless device 200. The wireless device 200 of FIG. 2 may be used in a fashion similar to that of wireless device 110 as shown in and described with respect to FIG. 1. The components of wireless device 200 can be implemented on one or more circuit boards. The wireless device 200 of FIG. 2 includes a data input/output (I/O) module 205, radio modulator/demodulator 215, an antenna selector 220, a data processor 225, and diode switches 230, 235, 240, and 245. Block diagram 200 also illustrates mountable antenna and reflector sets 250.

The data I/O module 205 of FIG. 2 receives a data signal from an external source such as a router. The data I/O module 205 provides the signal to wireless device circuitry for wireless transmission to a remote device (e.g., nodes 110-140 of FIG. 1). For example, the wired data signal can be processed by data processor 225 and radio modulator/demodulator 215. The processed and modulated signal may then be transmitted via one more antenna elements within the mountable antenna and reflectors 250 as described in further detail below.

The antenna selector 220 of FIG. 2 can select one or more antenna elements within mountable antenna and reflectors 250 to radiate the processed and modulated signal. Antenna selector 220 is connected to and may control one or more of diode switches 230, 235, 240, or 245 to direct the processed data signal to the one or more antenna sets 250. Antennal selector 220 may also select one or more reflectors for reflecting the signal in a desired direction. Processing of a data signal and feeding the processed signal to one or more selected antenna elements is described in detail in U.S. Pat. No. 7,193,562, entitled, "Circuit Board Having a Peripheral Antenna Apparatus with Selectable Antenna Elements," the disclosure of which is incorporated by reference.

The mountable antenna and reflectors 250 include at least one antenna element and at least one reflector and can be located at various locales on the circuit board of a wireless device, including at the periphery of the circuit board. A mountable antenna element may also be used in a wireless device without a reflector. Each set of mountable antenna and reflectors 250 may include an antenna element configured to operate at one or more frequencies. Each mountable antenna may be configured to radiate at a particular frequency, such as 2.4 GHz or 5.0 GHz. To minimize any potential interference between antennas radiating at different frequencies within a wireless device, mountable antennas radiating at different frequencies can be placed as far apart as possible on a circuit board, for example at opposite corners of a circuit board surface as is illustrated in FIG. 2.

Figure 3:
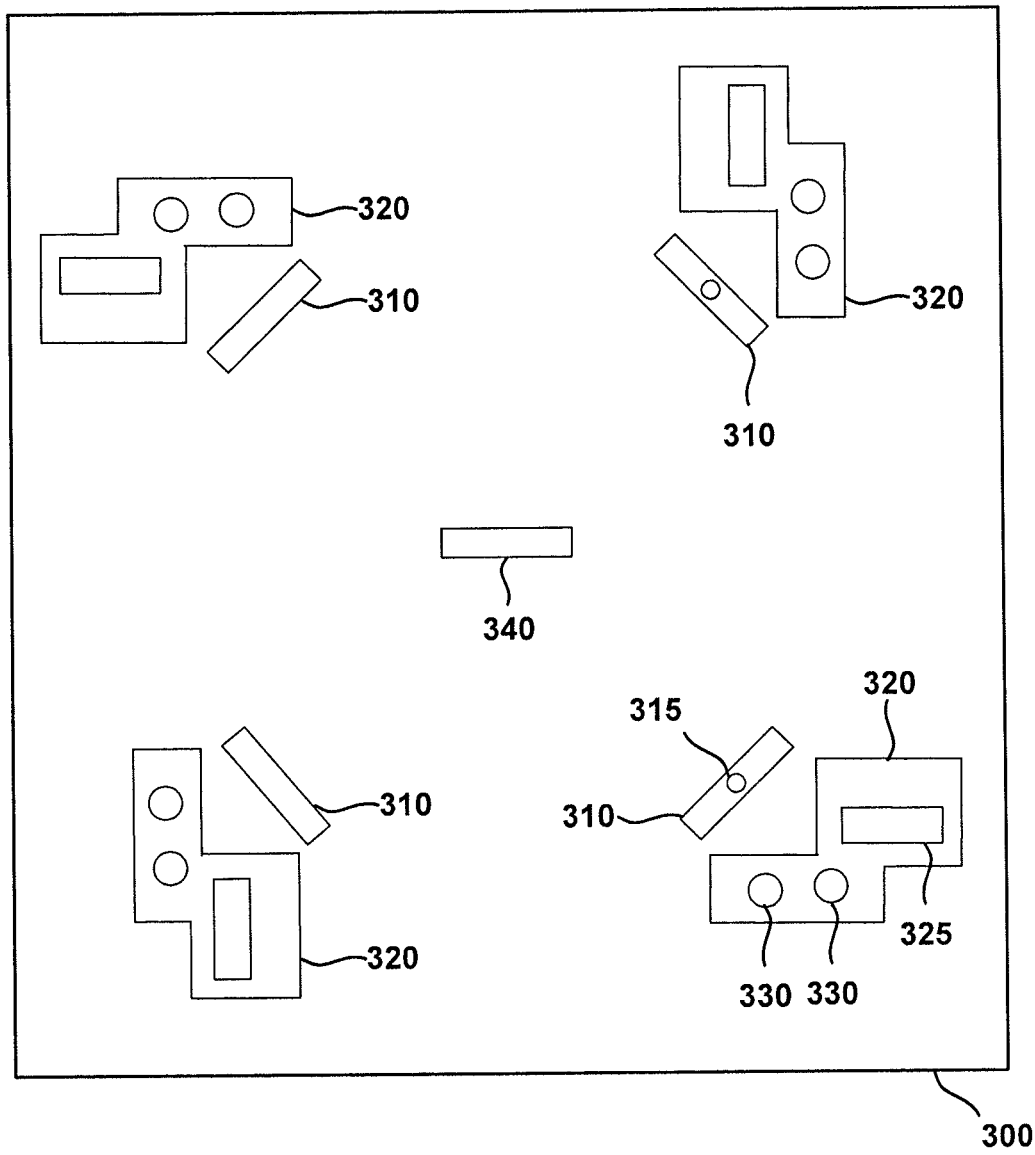
FIG. 3 illustrates a portion of a circuit board for receiving mountable antenna elements and reflectors, like those referenced in FIG. 2.

FIG. 3 illustrates a portion of a circuit board 300 for receiving a mountable antenna element and reflectors. The circuit board 300 of FIG. 3 is associated with a circuit board footprint corresponding to mountable antenna and reflectors 250 of FIG. 2. Thus, the circuit board portion illustrated in FIG. 3 provides more detail for each of the four mountable antenna and reflectors 250 of FIG. 2. The circuit board 300 includes coupling pads and holes for the coupling of an antenna element and reflectors to the board. Portions of the footprint (e.g., those related to attaching capacitors, resistors, and other elements) are not illustrated for simplicity.

An antenna element can be coupled to the circuit board 300 at coupling pads 310 and 340. A coupling pad is a pad connected to circuit board circuitry (for example a switch 230 or ground) and to which the antenna element can be connected, for example via solder. The antenna element can include a coupling plate having a surface that, when mounted to the circuit board, is roughly parallel and in contact with the circuit board coupling pads 310 and 340. A coupling plate is an antenna element surface (e.g., a surface at the end of an antenna element leg) that may be used to connect the antenna element to a couple pad. Antenna elements having a coupling plate (e.g., coupling plate 470) are illustrated in FIGS. 4-6B and 9-11. The antenna element coupling plate can be coupled (e.g., by solder) to the couple pads 310 and 340 such that the antenna element is mechanically and electronically coupled to a particular coupling pad 310. Coupling pads 310 can be connected to ground and coupling pad 340 can be connected to a radio modulator/demodulator 215 through a diode switch (e.g., diode switch 230).

A circuit board mounting pad 310 can include one or more coupling pad holes 315. A coupling pad hole 315 is an aperture or opening that extends from the surface into one or more layers of the circuit board. The coupling pad holes can receive an antenna element pin to help the secure antenna element to the circuit board 300. The antenna element can be positioned in place on the circuit board 300 by inserting one or more pins of the antenna element into a circuit board coupling pad hole 315. Once one or more antenna element pins are inserted into the appropriate coupling pad holes, the antenna element can be secured to the circuit board by means of soldering or some other coupling operation. An antenna element with one or more pins and a coupling plate is discussed in more detail with respect to FIGS. 4-6B.

A reflector can be mounted to the circuit board 300 at coupling area 320. Coupling area 320, as illustrated in FIG. 3, can include a mounting pad 325 and one or more holes 330. A mounting pad is a pad connected to circuit board circuitry (for example a switch 230 or ground) and to which a reflector can be connected, for example via solder. The mounting pad 325 can be coupled to a mounting plate of a reflector (for example, mounting plate 720 in the reflector illustrated in FIG. 7A) such that the reflector is electronically and mechanically attached to the mounting pad 325. The mounting pad 325 may be connected to ground layer of the circuit board through a switch, such as one of switches 220-235 as illustrated in FIG. 2. When a switch connected to the reflector is open, the reflector does not change the radiation pattern of a mounted antenna element. When the switch is closed such that the reflector is connected to the ground layer, the reflector operates to reflect the radiation pattern directed at the particular reflector.

The holes 330 of coupling area 320 are formed by an aperture or opening that extends from the surface into one or more layers of the circuit board and can be used to position a reflector in an appropriate position over coupling area 320. When a reflector has one or more pins inserted into corresponding holes 330 and a mounting plate (e.g., mounting plate 720 of FIG. 7A) in contact with coupling pad 325, the reflector can stand in an upright position over coupling area 320 without further support. Once a reflector is positioned upright on coupling area 320 using holes 330 and the reflector pins, the reflector can be coupled to a mounting pad 325 by soldering or some other coupling operation.

A reflector that can maintain an upright position without external support, for example by a machine or person, allows for easy attachment of the reflector to the circuit board 300. A reflector with one or more pins and a coupling plate is discussed in more detail with respect to FIGS. 7A-9.

An antenna element and reflector can be designed in combination to operate at a desired frequency, such as 2.4 gigahertz (GHz) or 5.0 GHz. FIGS. 4-8 illustrate exemplary antenna element and reflector combinations for a first frequency. FIGS. 9-13 illustrate exemplary antenna element and reflector combinations for a second frequency. The antenna elements and reflectors described below can be modified to operate at other desired frequencies.

Figure 4:
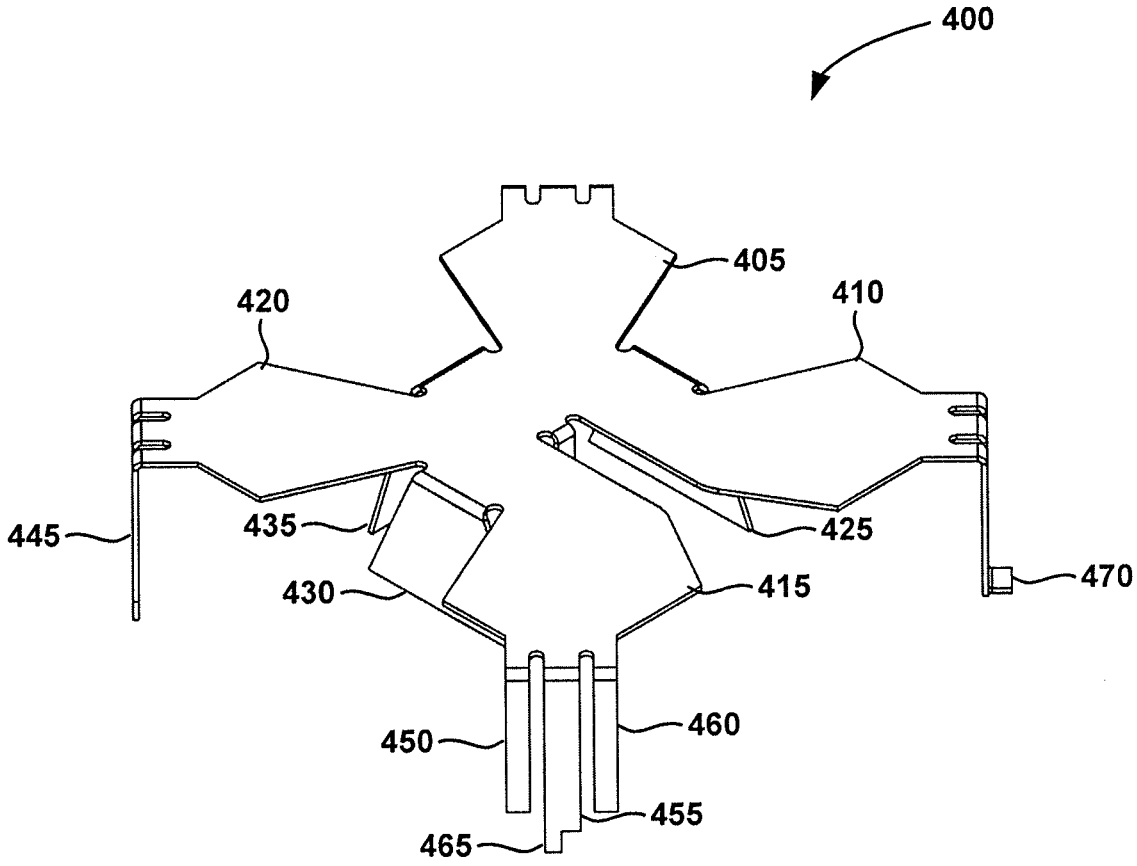
FIG. 4 is a perspective view of a mountable antenna element.

FIG. 4 is a perspective view of a mountable antenna element 400. The mountable antenna element 400 of FIG. 4 can be configured to radiate at a frequency such as 2.4 GHz. Extending horizontally outward from the center of a top surface of the antenna element 400 are top surface portions 405, 410, 415 and 420. Extending downward from each top surface portion is a leg (e.g., 455), and a stub on each side of each leg (e.g., stubs 450 and 460). As illustrated in FIG. 4, each set of a leg and two stubs extends downward at about a ninety degree angle from the plane formed by the top portions 405-420.

The antenna element legs can be used to couple the antenna element to circuit board 300 (FIG. 3). An antenna element leg can include a coupling plate 470 or a leg pin 465. A coupling plate 470 can be attached through solder to a coupling pad 310 on circuit board 300. An antenna element leg can also be attached to circuit board 300 by a leg pin 465. Leg pin 465 may be inserted into a coupling pad hole 315 in circuit board 300. An antenna element can be positioned on a circuit board by inserting the leg pins in a matching set of coupling pad holes 315 and then soldering each leg (both coupling plate and pins) to their respective coupling pads 310.

When the antenna element coupling plate 470 is connected to circuit board coupling pad 340 and a switch connecting the coupling pad 340 to radio modulator/demodulator 215 is open, no radiation pattern is transmitted or received by the mounted antenna element. When the switch is closed, the mounted antenna element is connected to radio modulator/demodulator 205 and may transmit and receive RF signals.

The antenna element stubs 450 and 460 may increase the performance of the wireless device 100 when utilizing different antenna elements to operate at multiple frequencies simultaneously, which may be referred to as concurrent dual band operation. The mountable antenna elements that operate at a smaller frequency may be larger in size than the mountable antenna elements that operate at a larger frequency. The larger mountable antenna elements, in such an instance, can interfere with the operation of the smaller antenna elements. For example, when a smaller sized antenna element (e.g., the antenna element of FIGS. 9-11) is operating at 5.0 GHz, the radiation received at antenna element 400 may cause a current to travel up a leg 455 of the larger sized antenna element 400 and towards the top portion 415. The current induced in a leg of the antenna element 400 by radiation from the smaller sized and higher frequency antenna element can affect the radiation pattern of the smaller sized antenna element and adversely affect the efficiency of wireless device 100.

To prevent the induced current, stubs 450 and 460 may create an open circuit when a radiation signal is received at the operating frequency of the smaller sized antenna element. Hence, when antenna element 400 is configured as a 2.4 GHz antenna element and operating on the same circuit board as a 5.0 GHz antenna element, stubs 450 and 460 are excited by the received 5.0 GHz radiation signal and form an open circuit at the base (the end of the leg that connects to the circuit board 300) of leg 455. The open circuit is created at the base of leg 455 at 5.0 GHz. By forming an open circuit for a 5.0 GHz signal at the base of leg 455, no current is induced through leg 455 by radiation of the higher frequency antenna element, and the larger sized antenna element 400 operating at a lower frequency does not affect the radiation of the smaller antenna element operating at a higher frequency.

The length of the stubs 450 and 460 can be chosen at time of manufacture based on the frequency of the antenna element from which radiation is being received. The total length for current traveling from the tip of one stub to the tip of the other stub can be about one half the wavelength of the frequency at which the open circuit is to be created (e.g., about three centimeters total travel length to create an open circuit for a 5.0 GHz signal). For an antenna leg with two stubs, each stub can be a little less than half of the corresponding wavelength (providing for most of the length in the stubs and a small part of the length for traveling between the stubs along a top surface portion).

Extending downward from near the center of the top surface 405, 410, 415, 420 are impedance matching elements 425, 430 and 435. Impedance matching elements 425, 430, 435 as illustrated in FIG. 4 extend downward from the top surface, such as impedance matching element 430 extending downward between top surface portions 415 and 420 and impedance matching element 435 extending downward between top surface portions 420 and 405.

Impedance matching elements 425-435 extend downward towards a ground plane within circuit board 300 and form a capacitance between the impedance matching element and the ground plane. By forming a capacitance with the ground plane of the circuit board 300, the impedance matching elements achieve impedance matching at a desired frequency of the antenna element. To achieve impedance matching, the length of the impedance matching element and the distance between the circuit board ground plane and the closest edge of the downward positioned impedance matching element can be selected based on the operating frequency of the antenna element. For example, when an antenna element 400 is configured to radiate at about 2.4 GHz, each impedance matching element may be about 8 millimeters long and positioned such that the edge closest to the circuit board is about 2-6 millimeters (e.g., about 3.6 millimeters) from a ground plane within the circuit board.

Figure 5:
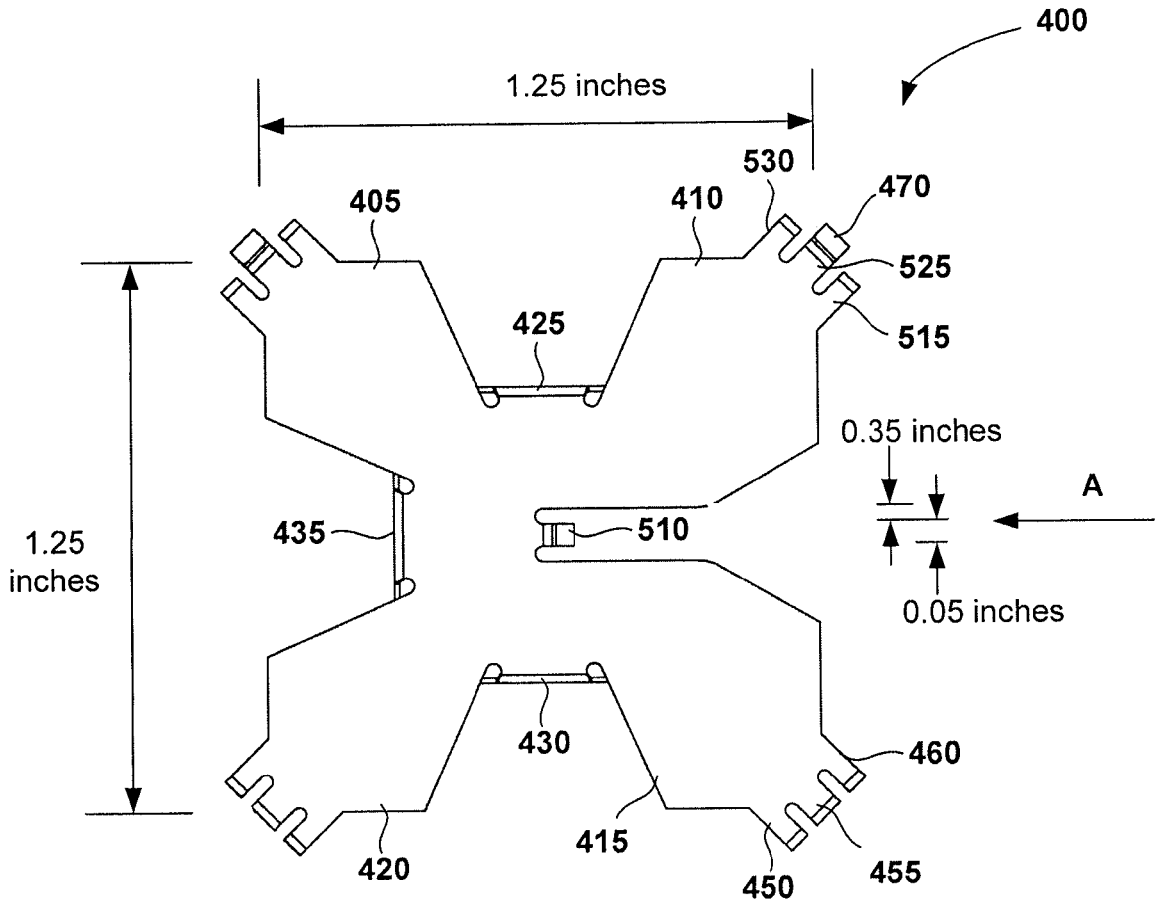
FIG. 5 is a top view of the mountable antenna element of FIG. 4.

FIG. 5 is a top view of the mountable antenna element 400 of FIG. 4. The top view of antenna element 400 illustrates an radio frequency (RF) feed element 510 that can be coupled to coupling pad 340 on circuit board 300. The RF feed element 510 includes a plate that can be coupled via solder or some other process for creating a connection between the coupling pad 340 and antenna element 400 through which an RF signal can travel.

The mountable antenna element 400 of FIG. 5 is configured to radiate at 2.4 GHz. The configuration illustrated in FIG. 5 includes a width and length of about 1.25 inches. The width of the RS feed 510 is about 0.05 inches. The spacing between the RS feed and top surface portion 410 is about 0.35 inches. This particular configuration is exemplary. Other configurations and radiation frequencies may be implemented in the context of the present invention.

Figure 6A:
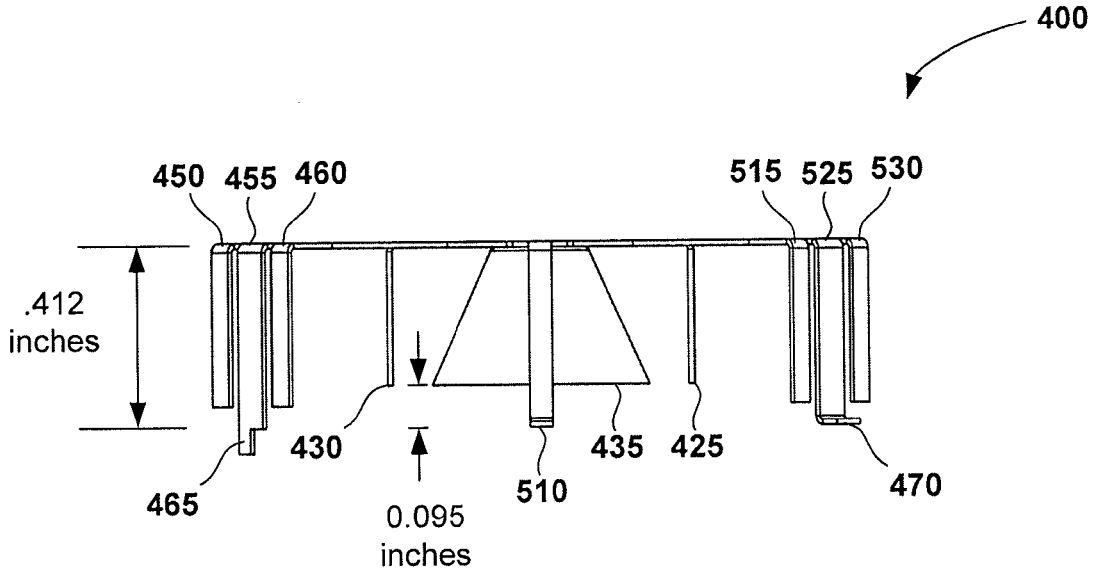
FIG. 6A is a side view of the mountable antenna element of FIG. 4.

FIG. 6A is a side view of the mountable antenna element 400 of FIG. 4. The side view is from the line of perspective "A" as indicated in FIG. 5. FIG. 6A illustrates leg 455 with corresponding stubs 450 and 460 and leg 525 with corresponding stubs 515 and 530. The outer end of leg 455 includes a leg pin 465 and the outer end of leg 470 includes a mounting plate 470. The distance between the bottom surface of the plate on RF feed element 510 and the top surface of the antennae element is about is about 0.412 inches. The distance between the top surface of the antenna element and each of plate 470 on leg 615 and the bottom of leg 455 (e.g., the top of pin 465) is also about 0.412 inches. The impedance matching elements 425, 430 and 435 are collectively about the same length from the top surface of the mountable antenna element 400, and can have a length of about 0.317 inches.

Figure 6B:
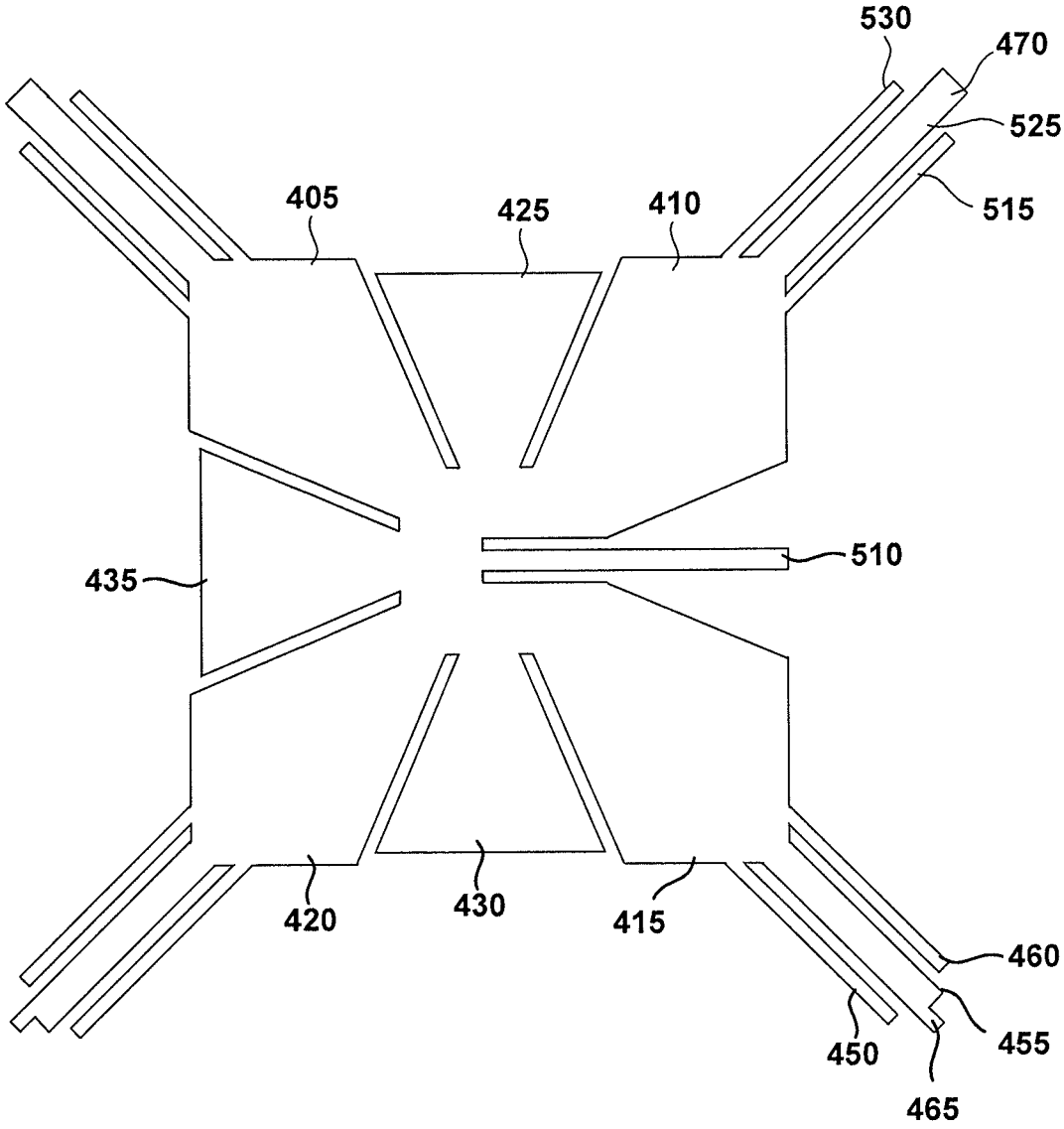
FIG. 6B is a top view of a single object or piece of material for forming an exemplary mountable antenna element.

FIG. 6B is a top view of a single object or piece of material for forming an exemplary mountable antenna element 400. As illustrated in FIG. 6B, the single piece of material is flat; no portions, legs, impedance matching elements or plates having been subjected to shaping by bending or manipulation. The mountable antenna element of FIGS. 4-6A can be formed by constructing the single element illustrated in FIG. 6B as one piece of material, such as tin material, and manipulating portions of the material. In particular, impedance matching elements 425, 430 and 435 can be bent downward to a position perpendicular to portions 405, 410, 415, and 420, and legs such as 470 and 455 and stubs such as 515, 530, 450 and 460 can be bent downward along the same direction as the impedance matching elements. RF feed element 510 can also be bent downward, and the edge of RF feed element 510 and leg 470 can be bent to form a plate to be coupled to circuit board 300. By constructing the antenna element 400 from a single piece of material that can be bent to operate at a tuned frequency such as 2.4 GHz while not interfering with an antenna element operating at a higher frequency (per the tuning of the stubs for each leg), the antenna element 400 can be built and installed easier than antenna elements that require additional components to generate a matching impedance.

Figure 7A:
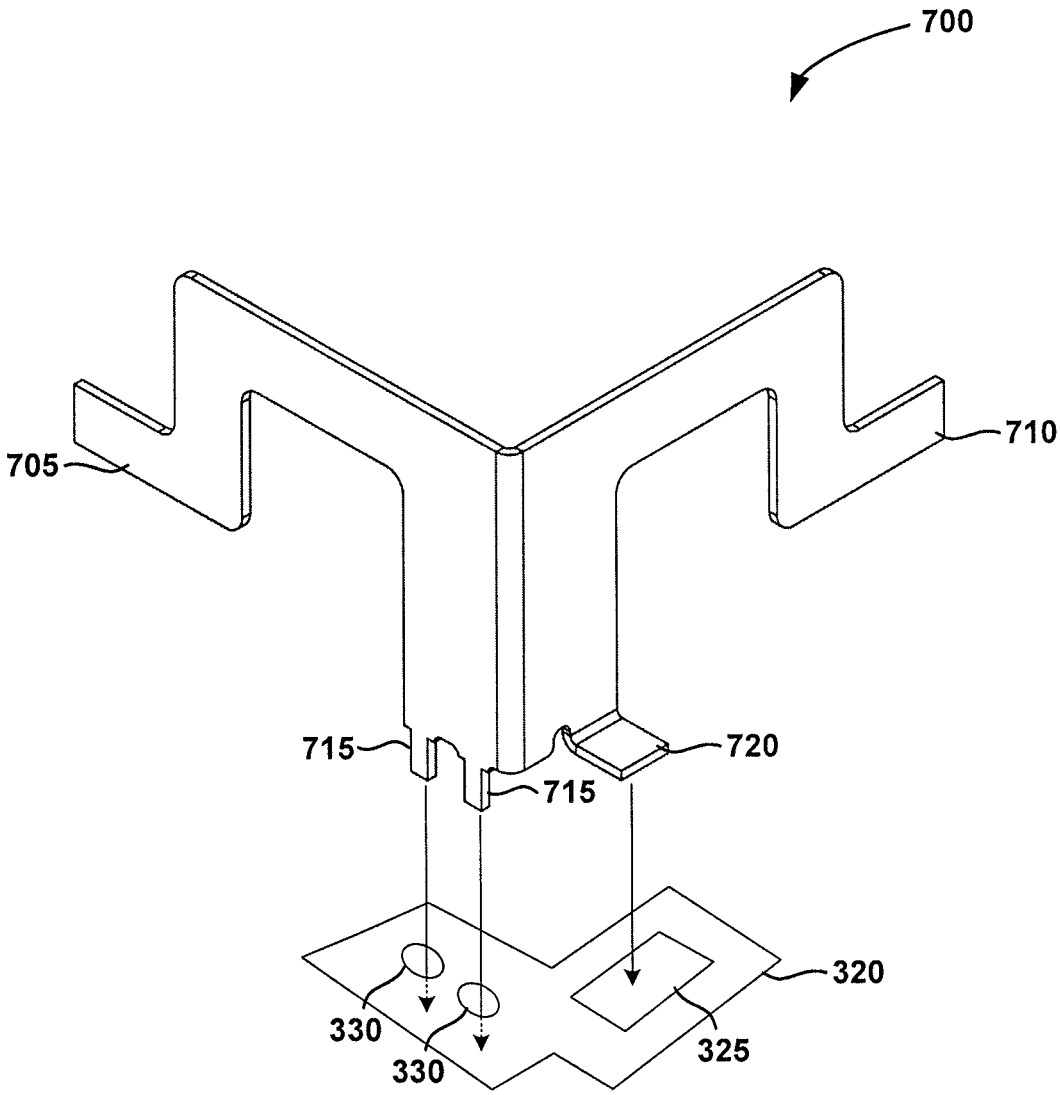
FIG. 7A is perspective view of a mountable reflector.

FIG. 7A is a perspective view of a mountable reflector 700. Reflector 700 includes a first side 705 and a second side 710 disposed at an angle of about ninety degrees from one another. The two sides 705 and 710 meet at a base end and extend separately to a respective outer end. The base end of side 705 includes two mounting pins 715. As illustrated in FIG. 7A and discussed above with respect FIG. 3, the mounting pins may be used to position reflector 700 in holes 330 of a mounting area 320 of circuit board 300. The base end of side 710 includes a coupling plate 720 for coupling the reflector to a mounting pad 325 of mounting area 320 (e.g., by solder). The pins 715 can also be coupled to mounting area 320 via solder. Once the pins 715 are inserted into holes 330 and coupling plate 720 is in contact with a mounting pad 325 as illustrated in FIG. 7A, the reflector 700 can stand upright over mounting area 320 without additional support.

Reflector 700 can be constructed as an object formed from a single piece of material, such as tin, similar to the construction of antenna element 400. The reflector 700 can be symmetrical except for the pins 715 and the plate 720. Hence, the material for reflector 700 can be built as a flat and approximately "T" shaped unit with a center portion with arms extending out to either side of the center portion. The flat element can then be bent, for example, down the center of the base such that each arm is of approximately equal size and extends from the other arm at a ninety-degree angle.

Figure 7B:
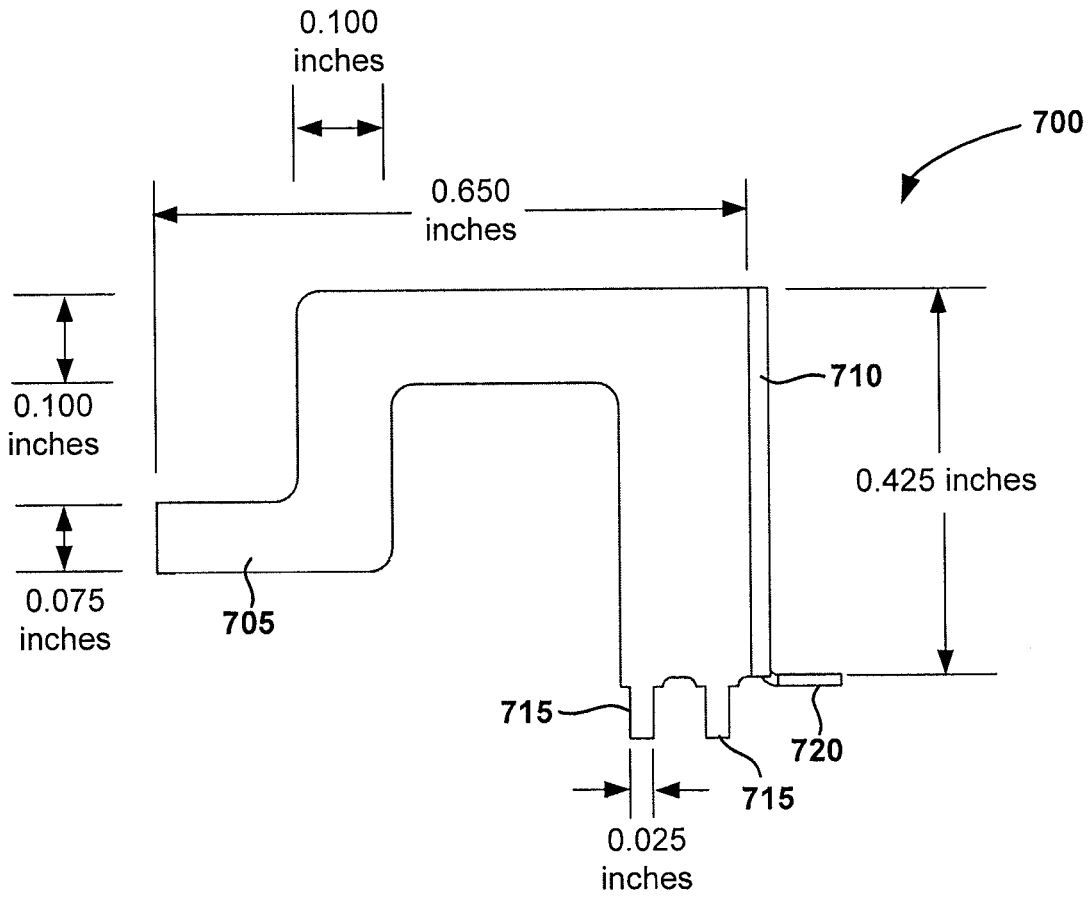
FIG. 7B is side view of the mountable reflector of FIG. 7A.

FIG. 7B is a side view of the mountable reflector 700 of FIG. 7A. To reflect a frequency of about 2.4 GHz, a side (e.g., side 705) can have a length of 0.650 inches. The side 705 can extend in a non-linear shape as illustrated. The non-linear shape may have different portions in different directions and widths, for example a first top portion having a width of 0.100, a second connecting portion having width of 0.100, and an outmost end portion having a width of 0.075. The reflector can have a height of 0.425 inches from the top reflector top to the coupling plate. The reflector pins can have a width of 0.025 inches.

Figure 8:
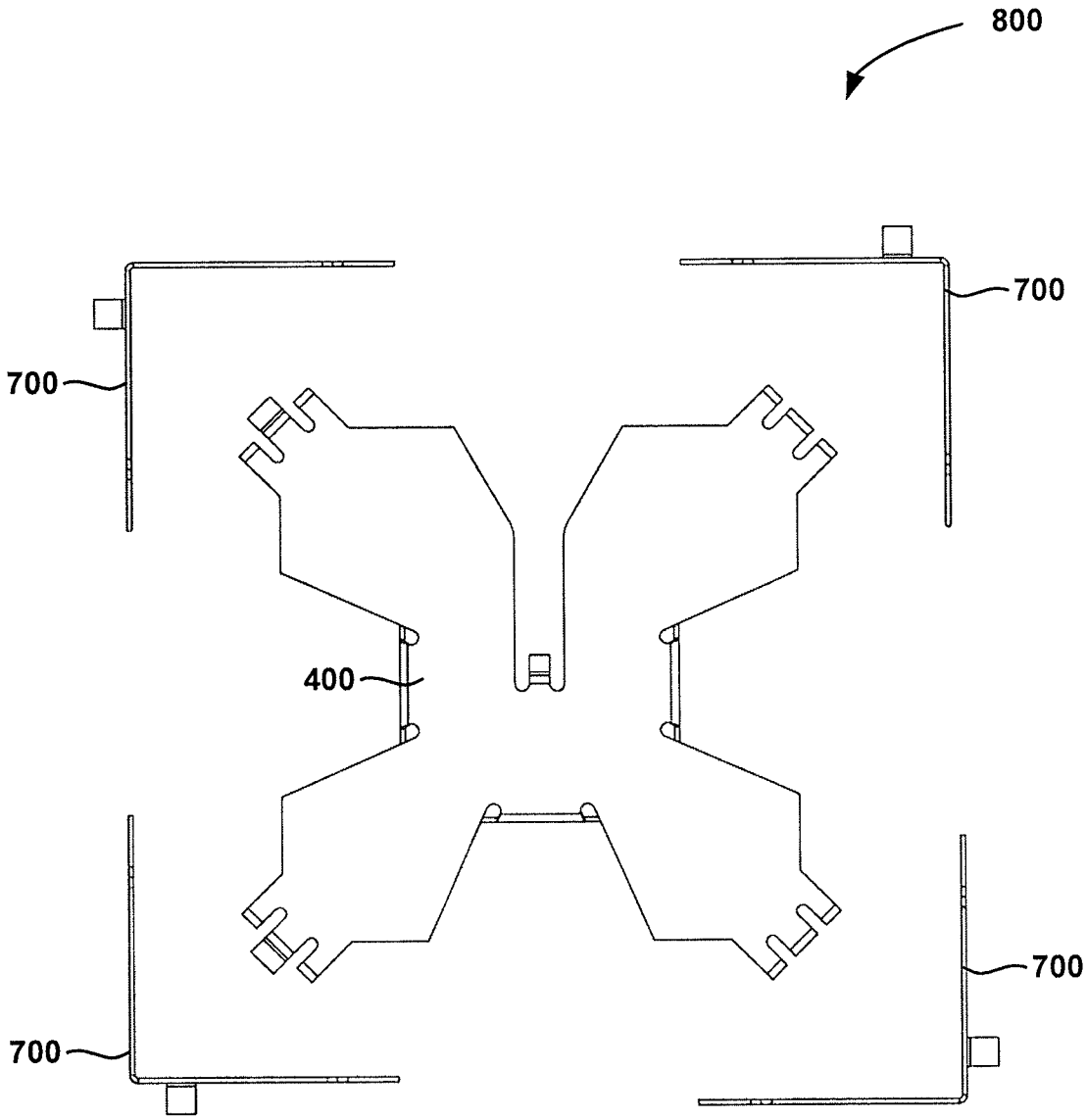
FIG. 8 is a top view of a mountable antenna element and an array of mountable reflectors.

FIG. 8 is a top view of a mountable antenna element 400 and an array of mountable reflectors 700. When mounted to mounting pads 310 and 340 and mounting areas 320, the mountable antenna element 400 and reflectors 700 can be configured approximately as shown in FIG. 8. A reflector 700 can be positioned at each corner of the mountable antenna element 400. The combination of mountable antenna element 400 and reflectors 700 can be positioned at one or more of the positions 250 in the wireless device block diagram of FIG. 2. When omni-directional vertically polarized antenna element 400 radiates, one or more reflectors 700 can be shorted to ground to reflect radiation in a direction opposite of the direction from the antenna to the shorted reflectors. The result of the reflected radiation is that the transmitted signal can be directed in a particular direction.

Figure 9:
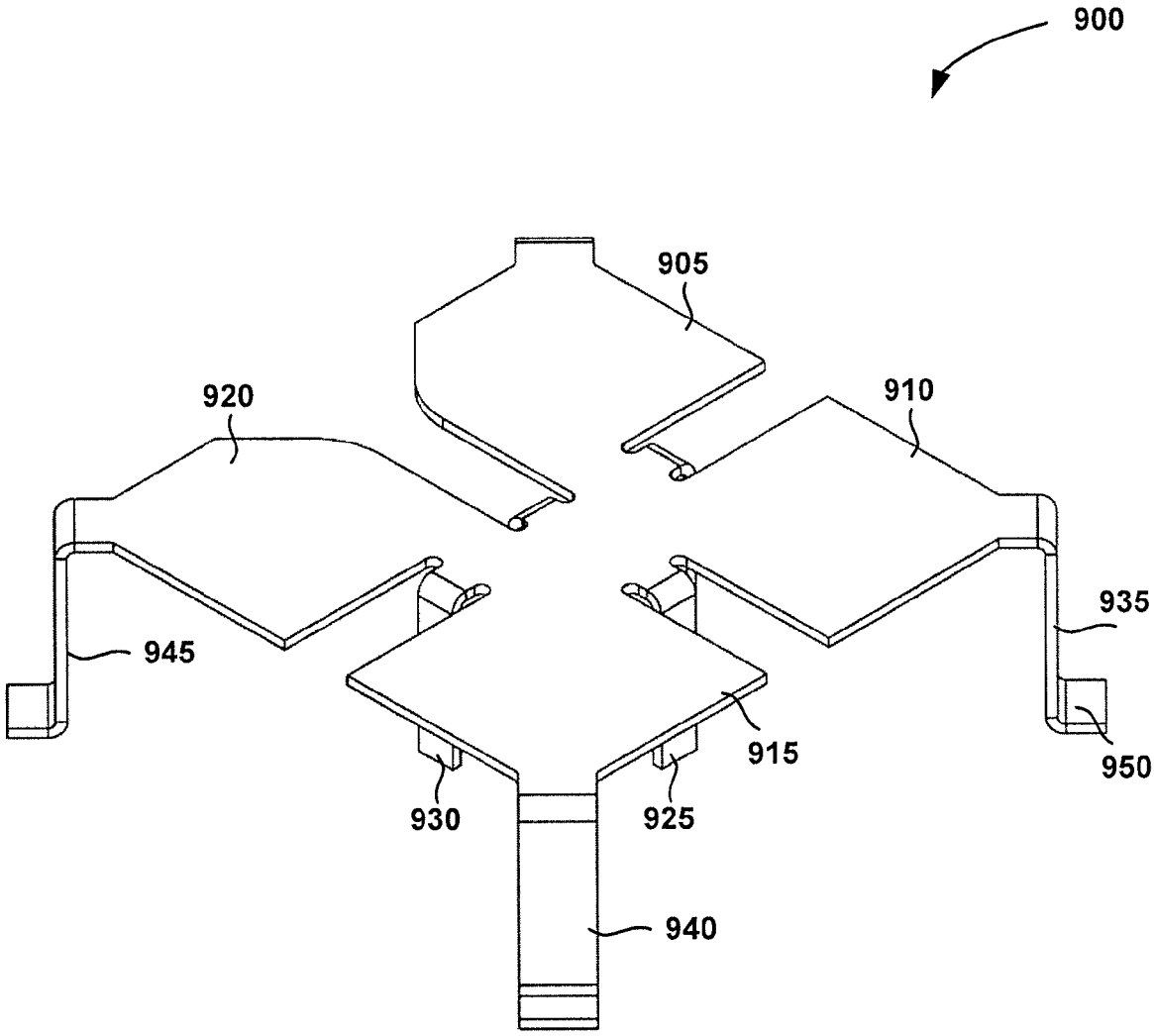
FIG. 9 is a perspective view of an alternative embodiment of a mountable antenna element.

FIG. 9 is a perspective view of an alternative embodiment of a mountable antenna element. The alternative embodiment of mountable antenna element 900 can be configured to radiate with vertical polarization at a frequency of about 5.0 GHz. Extending horizontally outward from the center of a top surface of the antenna element 900 are top surface portions 905, 910, 915, and 920. Extending downward from each top surface portion is a legs 935, 940, and 945, such as leg 940 extending from top portion 915. A fourth leg positioned opposite to leg 940 and extending from top portion 905 is not visible in FIG. 9. Each leg can extend downward at about a ninety degree angle from the plane formed by the top surface portions 905-920.

The antenna element legs can be used to couple the antenna element to circuit board 300 (FIG. 3). An antenna element leg can include a coupling plate 950 or a leg pin (not illustrated in FIG. 9). The coupling plate can be attached, for example through solder, to a coupling pad 310 on circuit board 300. An antenna element leg can also be attached to circuit board 300 by a leg pin extending from the leg. The antenna element 900 can be coupled to a circuit board by inserting the leg pins in corresponding coupling pad holes 315 and soldering each leg (both coupling plate and pins) to their respective coupling pads 310.

Extending downward from near the center of the top surface are impedance matching elements 925 and 930. A third impedance matching element is positioned opposite to impedance matching element 930 but not visible in the view of FIG. 9. The impedance matching elements 925 and 930 can extend between an inner portion of each top portion, such as impedance matching element 930 extending downward between top portions 915 and 920 and impedance matching element 925 extending downward between top portions 910 and 915.

Impedance matching elements 925-930 extend downward from the top surface toward a ground plane within circuit board 300 and form a capacitance between the impedance matching element and the ground plane. The impedance matching elements achieve impedance matching at a desired frequency based on the length of the impedance matching element and the distance between the circuit board 300 ground plane and the closest edge of the downward positioned impedance matching element based. For example, when an antenna element 900 is configured to radiate at about 5.0 GHz, each impedance matching element may be about 5 millimeters long and positioned such that the edge closest to the circuit board is between 2-6 millimeters (e.g., about 2.8 millimeters) from a ground plane within the circuit board.

Figure 10:
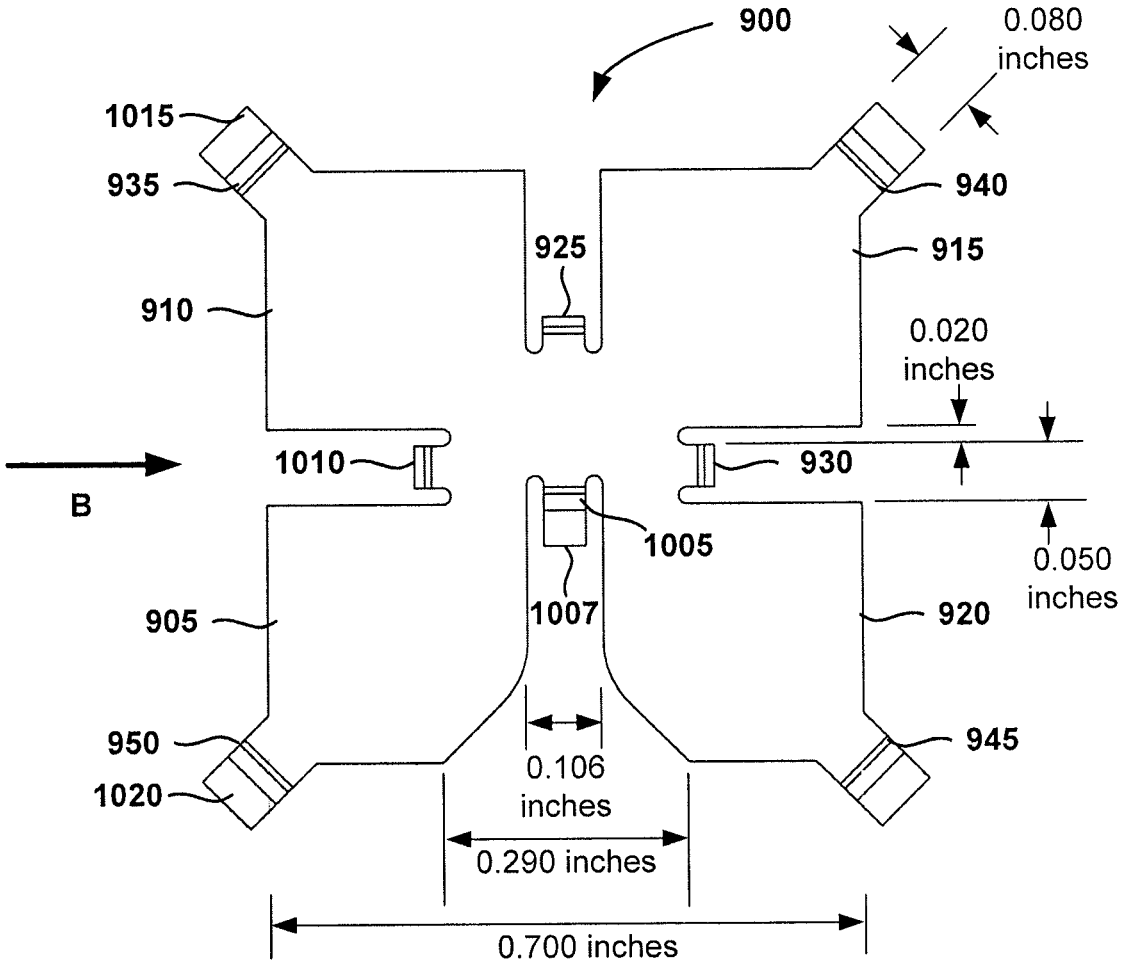
FIG. 10 is a top view of an alternative embodiment of a mountable antenna element.

FIG. 10 is a top view of an alternative embodiment of a mountable antenna element 900. The top view of antenna element 400 indicates an RF feed element 1005 that can be coupled to coupling pad 340 on circuit board 300. The RF feed element 1005 can include a coupling plate 1007 to be coupled to coupling pad 340 via solder or some other process for creating a connection between the RF source and antenna element 400.

The dimensions of the mountable antenna element 900 can be smaller than those for mountable antenna element 400. When the mountable antenna element 900 is constructed to operate at about 5.0 GHz, the width and length of the mountable antenna element top surface can be about 0.700 inches long. The width of the gap between top surface portions 905 and 920 is 0.106 inches at the inner most point and 0.290 at the outermost point. The width of the gap between top surface portions 915 and 920 is about 0.070 inches, with the gap width between a impedance matching element and a top surface portion (e.g., impedance matching element 930 and top surface portion 915) is about 0.020 inches.

Figure 11:
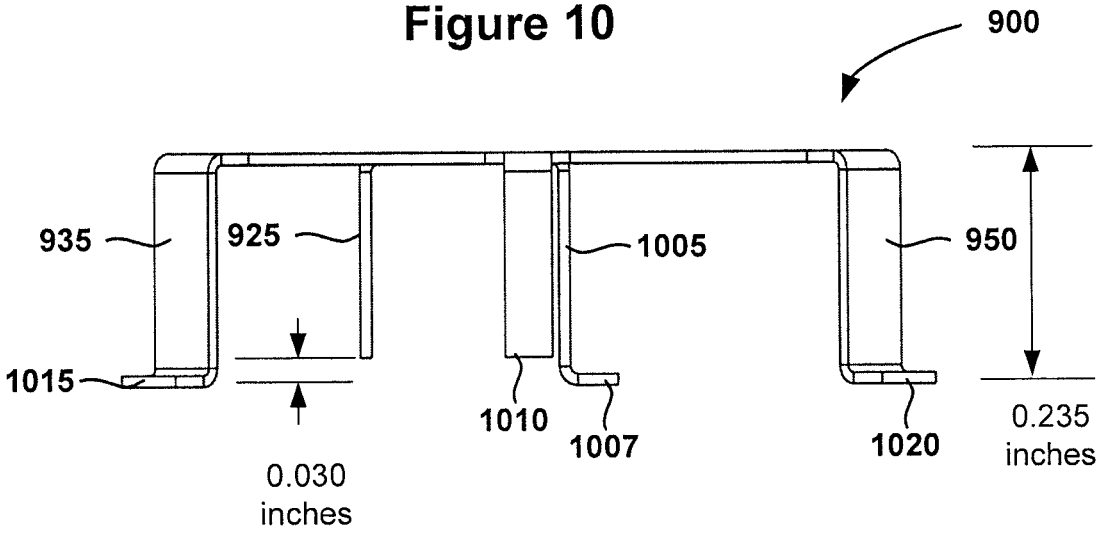
FIG. 11 is a side view of an alternative embodiment of a mountable antenna element.

FIG. 11 is a side view of an alternative embodiment of a mountable antenna element 900. The side view is from the perspective of line "B" as indicated in FIG. 10. FIG. 11 illustrates the antenna element with leg 935 having a coupling pad 1015 and leg 950 having a coupling pad 1020, wherein both coupling pads extending horizontally there from their corresponding leg. The bottom surface of the coupling plate 1007 on RF feed element 1005 is positioned about 0.235 inches from the antenna element top surface. Coupling plates 1015 and leg 1020 are also positioned about 0.235 inches from the antenna element top surface. Antenna element 900 can be connected to an RF signal (e.g., through pad 340) through RF feed element 1005. When an RF signal is provided to RF feed element 1005, a current is created that flows from RF feed element 1005 through each of top surface portions 905, 910, 915 and 920. The current enables the antenna element to radiate with a vertical polarization. The antenna element dimensions can be selected based on the operating frequency of the element. When operating at about 5.0 GHz, the antenna element can be about 0.235 inches high. The impedance matching elements 925, 1010 and 930 (not shown in FIG. 11) are collectively about the same length from the top surface of the mountable antenna element 900 and have a length of about 0.205 inches.

Antenna element 900 can be constructed as an object from a single piece of material, for example tin material. The mountable antenna element 900 can be formed from the single piece of material by manipulating portions of the material. In particular, antenna element impedance matching elements 925, 930 and 1010 can be bent downward, for example to a position perpendicular to top surface portions 905, 910, 915 and 920, and legs 935, 940, 945, and 950 can be bent downward along the same direction as the impedance matching elements. RF feed element 1005 can also be positioned in a downward direction with respect to the antenna element top surface, and the edge of RF feed element 1005 and leg 470 can be bent to form a coupling plate to be coupled to circuit board 300.

Figure 12:
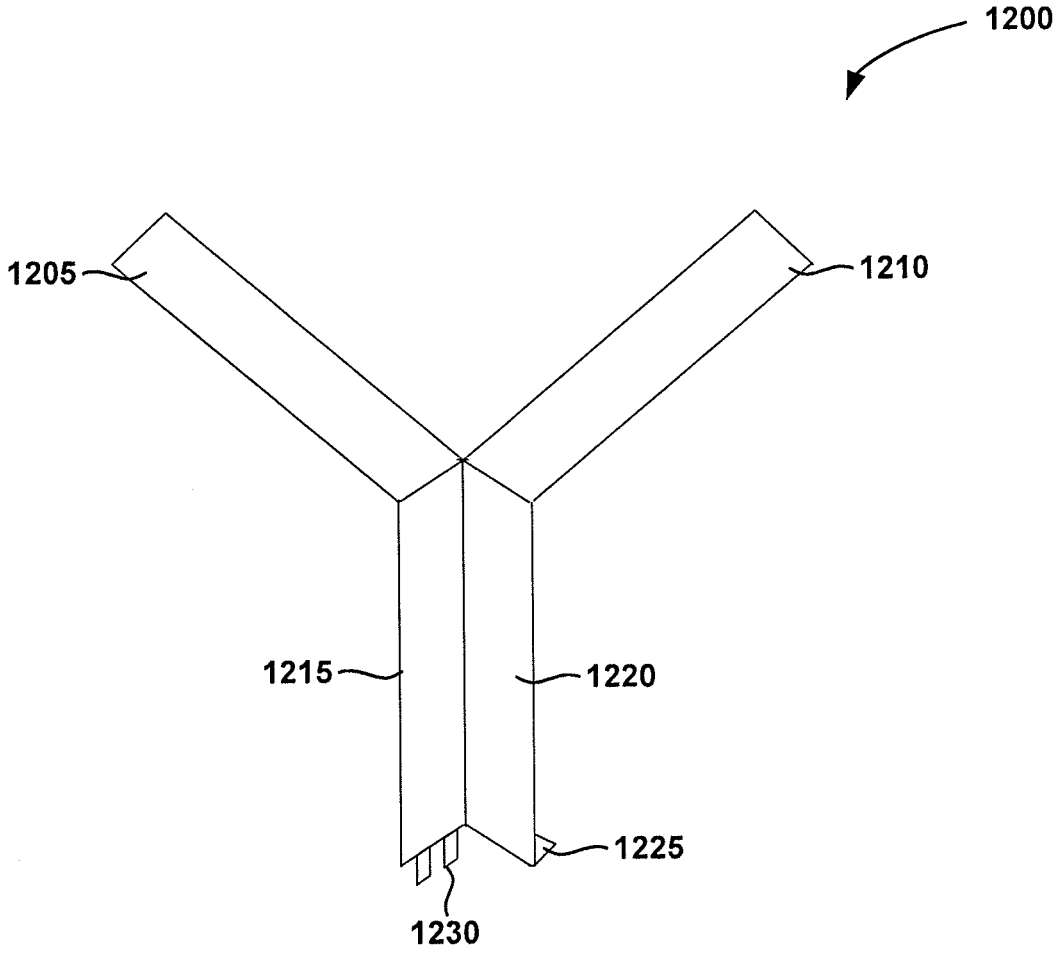
FIG. 12 is perspective view of an alternative embodiment of a mountable reflector.

FIG. 12 is a perspective view of an alternative embodiment of a mountable reflector 1200. The mountable reflector 1200 can be used to reflect a signal having a frequency of 5.0 GHz when connected to ground, for example a signal radiated by antenna element 900. Reflector 1200 includes two sides 1215 and 1220 which form a base portion and side extensions 1205 and 1210, respectively. The side extensions are configured to extend about ninety degrees from each other. Base 1215 includes two mounting pins 1230. As illustrated in FIG. 7A and discussed above, the mounting pins may be used to position reflector 1200, for example via solder, in holes 330 of a mounting area 320 of a circuit board 300.

Base 1220 includes a mounting plate 1225. Mounting plate 1225 can be used to couple reflector 1200 to circuit board 300 via solder. In addition to mounting plate 1225, pins 1215 can also be soldered to area 320. Once the pins 1230 are inserted into holes 330 and coupling plate 1225 is in contact with a mounting pad, the reflector 1200 can stand upright without additional support, making installation of the reflectors easer than typical reflectors which do not have mounting pins 1230 and a mounting plate 1225.

Reflector 1200 can be constructed as an object from a single piece of material, such as a piece of tin. The reflector 1200 can be symmetrical except for the pins 1230 and the plate 1225. Hence, the material for reflector 1200 can be built as a flat and approximately "T" shaped unit. The flat element can then be bent down the center such that each arm is of approximately equal size and extends from the other arm at a ninety-degree angle.

Figure 13:
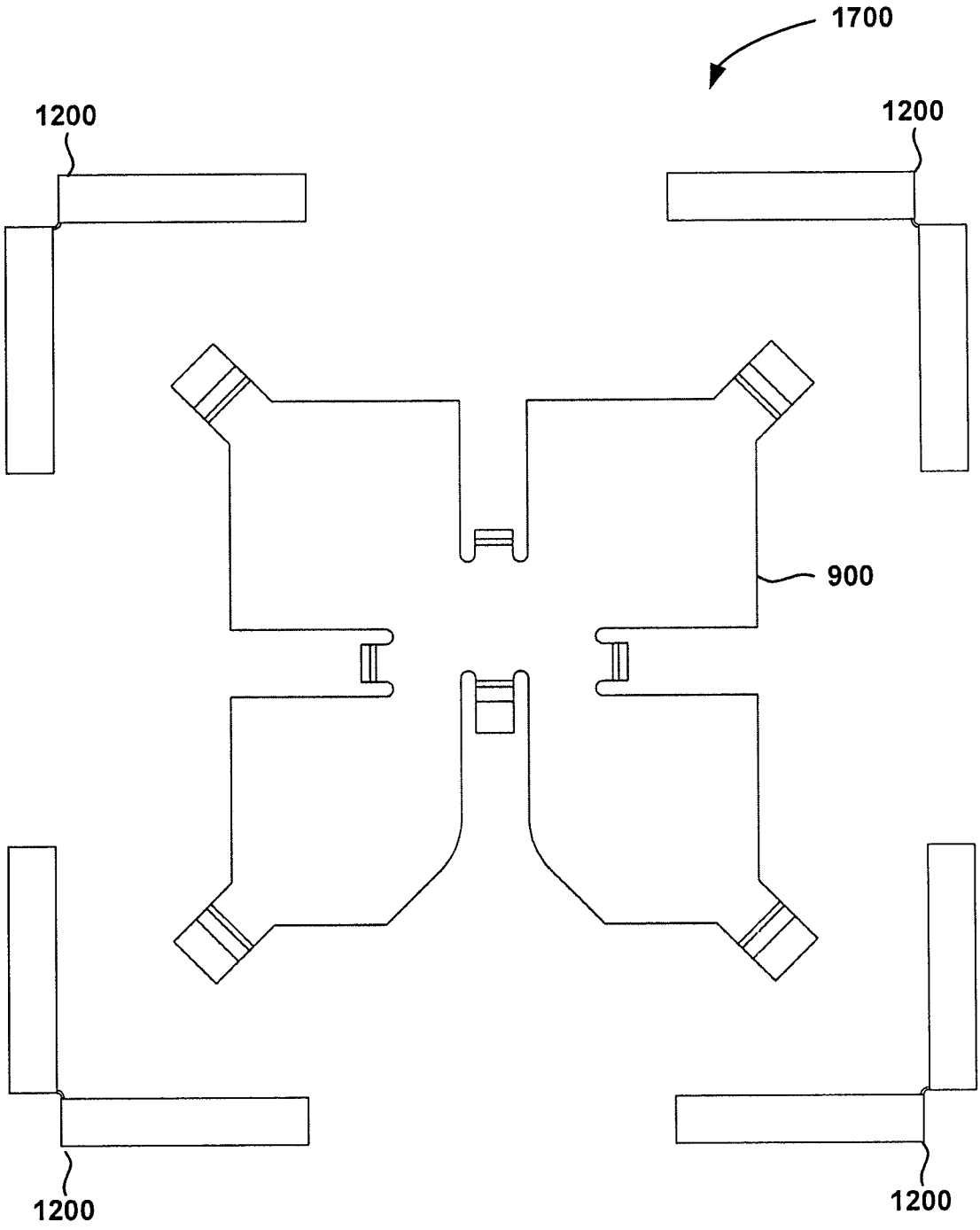
FIG. 13 is a top view of an alternative embodiment of a mountable antenna element and an array of mountable reflectors.

FIG. 13 is a top view of an alternative embodiment of a mountable antenna element 400 and an array of mountable reflectors 700. When mounted to mounting pads 310 and 340 and mounting areas 320, the mountable antenna element and reflectors can be configured approximately as shown in FIG. 13 such that the reflectors are positioned at each corner of the mountable antenna element 400. The combination of mountable antenna element 400 and reflectors 700 can be positioned at one or more of the positions 250 in the wireless device block diagram of FIG. 2. When omni-directional vertically polarized antenna element 400 radiates, one or more reflectors 700 can be shorted to ground to reflect radiation in a direction opposite of the direction from the antenna to the reflectors that are shorted.

Though a finite number of mountable antenna elements are described herein, other variations of single piece construction mountable antenna elements are considered within the scope of the present technology. For example, an antenna element 400 generally has an outline of a generally square shape with extruding legs and stubs as illustrated in FIG. 6B. Other shapes can be used to form a single piece antenna element, including a triangle and a circle, with one or more legs and impedance matching elements, and optionally one or more stubs to enable efficient operation with other antenna elements. Additionally, other shapes and configuration may be used to implement one or more reflectors with each antenna element.

Figure 14:
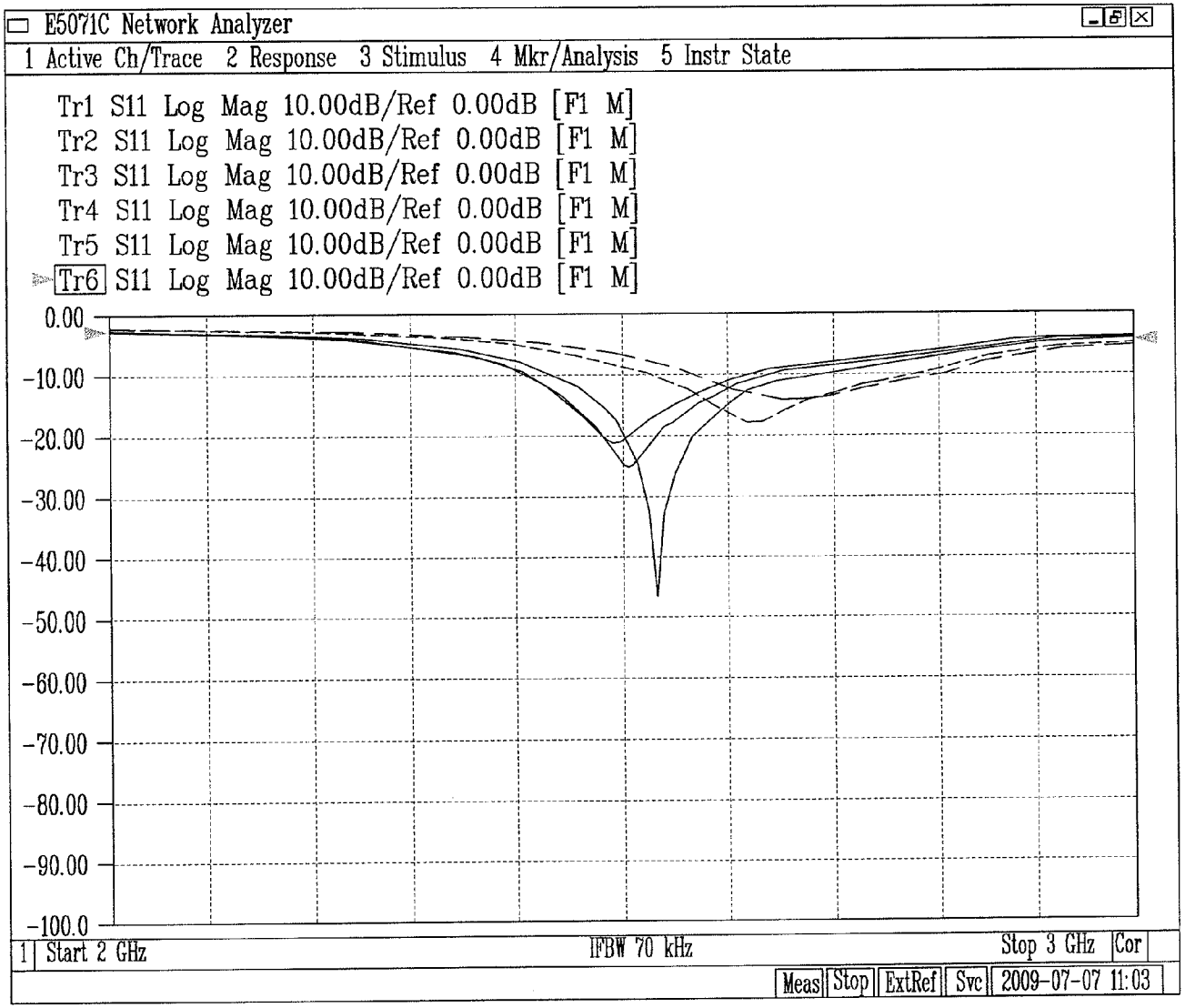
FIG. 14 is a graph illustrating a relationship between impedance matching element distance and impedance.

FIG. 14 is a graph illustrating a relationship between impedance matching element distance and impedance. The distance values correspond to the distance between an impedance matching element and a ground plane in a PCB. The corresponding impedance values show how the impedance (S11) can be influenced by adjusting the distance of the impedance matching element to ground. The set of curves in the figure was produced by varying the distance to ground between 60-90 millimeters. In some wireless devices, the impedance matching element to ground distance can be about 75 millimeters.

The embodiments disclosed herein are illustrative. Various modifications or adaptations of the structures and methods described herein may become apparent to those skilled in the art. Such modifications, adaptations, and/or variations that rely upon the teachings of the present disclosure and through which these teachings have advanced the art are considered to be within the spirit and scope of the present invention. Hence, the descriptions and drawings herein should be limited by reference to the specific limitations set forth in the claims appended hereto.

What is claimed is:

1. A self-standing mountable antenna that transmits a radio frequency signal, the antenna comprising:

a top surface in a first plane, the top surface formed from a single sheet of material;

a radio frequency feed extending from the top surface and coupled to a radio frequency source;

a plurality of legs extending from the top surface and coupled to a ground plane; and a first bendable impedance matching element extending from the top surface towards the ground plane, wherein the radio frequency feed, the legs, and the first bendable impedance matching element are all formed from the same single sheet of material as the top surface and are each bent downwardly therefrom towards the ground plane, and wherein the first bendable impedance matching element forms a capacitance with the ground plane that is determined by an adjustable spatial distance between a bottom edge of the first bendable impedance matching element and the ground plane, the spatial distance being adjustable by bending the first bendable impedance matching element with respect to the top surface.

2. The self-standing mountable antenna of claim 1, further including a second bendable impedance matching element positioned symmetrically across from the first bendable impedance matching element.

3. The self-standing mountable antenna of claim 1, wherein the mountable antenna is driven at a first frequency and the first bendable impedance matching element provides impedance matching at the first frequency.

4. The self-standing mountable antenna of claim 3, further including a stub extending from the top surface and positioned proximate to one of the plurality of legs, the stub forming an open circuit with the proximate leg when the proximate leg is exposed to a broadcast signal at a second frequency.

5. The self-standing mountable antenna of claim 4, wherein the length of the stub is about one-quarter of the wavelength of the second frequency.

6. The self-standing mountable antenna of claim 1, wherein one of the plurality of legs includes a coupling plate coupled to a surface.

7. The self-standing mountable antenna of claim 1, wherein one of the plurality of legs includes a leg pin received by an aperture in a surface.

8. The self-standing mountable antenna of claim 1, wherein the mountable antenna element is vertically polarized.

9. A wireless device that transmits a radiation signal, comprising:

a circuit board that receives a mountable antenna element, the mountable antenna element emitting a radiation signal at a first frequency;

a first mountable antenna coupled to the circuit board, wherein the first mountable antenna includes:

a radio frequency feed, a top surface formed from a single sheet of material, a plurality of legs coupling the first mountable antenna to the circuit board, and a bendable impedance matching element forming a capacitance with respect to a ground layer of the circuit board by extending from the first mountable antenna towards the ground layer such that the capacitance is determined by an adjustable spatial distance between a bottom edge of the bendable impedance matching element and the ground plane, the spatial distance being adjustable by bending the bendable impedance matching element with respect to the top surface, wherein the radio frequency feed, the top surface, the plurality of legs, and the impedance matching element are all formed from the same single sheet of material as the top surface and are each bent downwardly therefrom towards the ground plane; and a radio modulator/demodulator providing a radio frequency signal to the first mountable antenna at the first frequency.

10. The wireless device of claim 9, further comprising a reflector coupled to the circuit board and reflecting a radiation pattern of the first mountable antenna.

11. The wireless device of claim 10, wherein the reflector includes a coupling plate that couples to a mounting pad of the circuit board.

12. The wireless device of claim 10, wherein the circuit board includes an aperture, the aperture receiving the reflector.

13. The wireless device of claim 9, further comprising a second mountable antenna that emits a radiation signal at a second frequency.

14. The wireless device of claim 9, the first mountable antenna including a stub able to generate an open circuit with respect to the second frequency at a leg of the plurality of legs of the first mountable antenna.

15. The wireless device of claim 14, wherein the first mountable antenna includes a first stub with an outer end and a second stub with an outer end, the open circuit formed at the leg adjacent to the outer ends of the first stub and the second stub.

16. The wireless device of claim 10, wherein the second mountable antenna radiates at a higher frequency than the first mountable antenna.

* * * * *